US009720342B2

(12) United States Patent
Sato

(10) Patent No.: US 9,720,342 B2
(45) Date of Patent: Aug. 1, 2017

(54) DEVELOPING AGENT CONTAINER INCLUDING SUPPLY CHAMBER AND WASTE CHAMBER

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/569,935

(22) Filed: Dec. 15, 2014

(65) Prior Publication Data

US 2015/0098729 A1 Apr. 9, 2015

Related U.S. Application Data

(63) Continuation of application No. 13/941,070, filed on Jul. 12, 2013, now Pat. No. 8,913,918, which is a (Continued)

(30) Foreign Application Priority Data

Apr. 28, 2009 (JP) ..... 2009-109905

(51) Int. Cl.
*G03G 15/01* (2006.01)
*G03G 15/16* (2006.01)
(Continued)

(52) U.S. Cl.
CPC ..... *G03G 15/0121* (2013.01); *G03G 15/168* (2013.01); *G03G 21/105* (2013.01); *G03G 21/12* (2013.01); *G03G 2215/1661* (2013.01)

(58) Field of Classification Search
CPC .. G03G 15/0121; G03G 15/168; G03G 21/12; G03G 21/105
See application file for complete search history.

(56) References Cited

U.S. PATENT DOCUMENTS 4,518,248 A 5/1985 Nishikawa
5,126,799 A 6/1992 Matsuura et al.
(Continued)

FOREIGN PATENT DOCUMENTS

JP 59-192271 A 10/1984
JP 05-257340 A 8/1993
(Continued)

OTHER PUBLICATIONS

Machine translation of JP 2001272833 A.*
(Continued)

*Primary Examiner* — David Bolduc
(74) *Attorney, Agent, or Firm* — Banner & Witcoff, Ltd.

(57) ABSTRACT

An image forming device includes a housing; a conveying belt, and a retaining member. The retaining member retains image bearing members that juxtaposed with and spaced apart from one another. The retaining member is slidingly movable relative to the housing in a direction that the image bearing members are juxtaposed. The retaining member retains the image bearing members to confront the conveying belt. The image bearing members and the conveying belt are arranged in a reference direction. The retaining member includes a cleaning member that removes residual developing agent from the conveying belt, and a guide unit that guides the recording medium to the conveying belt. The guide unit is located on the image bearing member side and the cleaning member is located on the conveying belt side. At least part of the guide unit overlaps at least part of the cleaning member when projected in the reference direction.

4 Claims, 12 Drawing Sheets

Related U.S. Application Data continuation of application No. 12/732,235, filed on Mar. 26, 2010, now Pat. No. 8,488,991.

(51) Int. Cl.
*G03G 21/10* (2006.01)
*G03G 21/12* (2006.01)

(56) References Cited

U.S. PATENT DOCUMENTS

| | | | | |
|---|---|---|---|---|
| 5,268,720 | A | 12/1993 | Saitoh et al. | |
| 5,298,952 | A | 3/1994 | Kamijo et al. | |
| 5,315,357 | A | 5/1994 | Kamijo et al. | |
| 5,331,377 | A | 7/1994 | Matsuura et al. | |
| 5,629,760 | A | 5/1997 | Hayashi et al. | |
| 5,907,752 | A | 5/1999 | Kondoh | |
| 6,167,227 | A * | 12/2000 | Fujita | G03G 15/0877 399/258 |
| 6,339,689 | B1 | 1/2002 | Sugiura | |
| 6,418,284 | B1 | 7/2002 | Mercer | |
| 6,711,366 | B2 | 3/2004 | Beaufort | |
| 7,424,263 | B2 | 9/2008 | Shimizu et al. | |
| 7,634,213 | B2 | 12/2009 | Yoshida et al. | |
| 7,720,428 | B2 | 5/2010 | Hagi et al. | |
| 7,899,355 | B2 | 3/2011 | Sakuma | |
| 8,180,253 | B2 | 5/2012 | Hayashi et al. | |
| 2003/0223776 | A1 | 12/2003 | Kato et al. | |
| 2004/0009009 | A1 | 1/2004 | Beaufort | |
| 2004/0047651 | A1 * | 3/2004 | Koyama | G03G 15/0868 399/120 |
| 2006/0002750 | A1 | 1/2006 | Ono | |
| 2006/0067734 | A1 | 3/2006 | Igarashi et al. | |
| 2006/0204272 | A1 * | 9/2006 | Ikeda | G03G 15/168 399/101 |
| 2007/0071482 | A1 | 3/2007 | Okabe | |
| 2008/0038014 | A1 | 2/2008 | Saiki et al. | |
| 2008/0181692 | A1 | 7/2008 | Tatsumi et al. | |
| 2008/0199234 | A1 | 8/2008 | Hagi et al. | |
| 2009/0035014 | A1 * | 2/2009 | Sato | G03G 15/0896 399/119 |
| 2009/0110456 | A1 | 4/2009 | Fujii | |
| 2009/0196652 | A1 | 8/2009 | Sakuma | |
| 2009/0238585 | A1 | 9/2009 | Hayashi et al. | |
| 2009/0285593 | A1 | 11/2009 | Sakuma | |
| 2009/0324284 | A1 * | 12/2009 | Ohta | G03G 21/12 399/120 |
| 2010/0074646 | A1 | 3/2010 | Miyahara et al. | |
| 2010/0178078 | A1 | 7/2010 | Tamura et al. | |
| 2010/0209157 | A1 | 8/2010 | Sato et al. | |

FOREIGN PATENT DOCUMENTS

| | | | |
|---|---|---|---|
| JP | 8-286478 | A | 11/1996 |
| JP | 2001272833 | A * | 10/2001 |
| JP | 2004-191435 | A | 7/2004 |
| JP | 2005-156780 | A | 6/2005 |
| JP | 2006-098772 | A | 4/2006 |
| JP | 2006-154195 | A | 6/2006 |
| JP | 2006-171295 | A | 6/2006 |
| JP | 2007-093830 | A | 4/2007 |
| JP | 2007-140144 | A | 6/2007 |
| JP | 2007-218936 | A | 8/2007 |
| JP | 2008-176163 | A | 7/2008 |
| JP | 2009-237560 | A | 10/2009 |
| JP | 2009-276438 | A | 11/2009 |
| JP | 2010-078848 | A | 4/2010 |
| JP | 2010-164632 | A | 7/2010 |
| JP | 2010-191012 | A | 9/2010 |
| JP | 2010-191013 | A | 9/2010 |

OTHER PUBLICATIONS

Japanese Office Action mailed Mar. 15, 2011 in Application No. 2009-109905 and English translation thereof.

CN Office Action dated Oct. 20, 2011, corresponding Application No. 201010155403.5; English Translation.

CN Office Action dtd Apr. 5, 2012, CN Application No. 201010155403.5, English Translation.

Machine translation of Japan Patent Pub. No. 2004-191435.

* cited by examiner

15Y(15), 15M(15), 15C(15)

15Y(15), 15M(15), 15C(15)

15Y(15), 15M(15), 15C(15)

DEVELOPING AGENT CONTAINER INCLUDING SUPPLY CHAMBER AND WASTE CHAMBER

CROSS REFERENCE TO RELATED APPLICATION

This application is a continuation of prior U.S. application Ser. No. 13/941,070, filed Jul. 12, 2013, which is a continuation of prior U.S. application Ser. No. 12/732,235, filed Mar. 26, 2010, now U.S. Pat. No. 8,488,991 B2, issued Jul. 16, 2013, which claims priority from Japanese Patent Application No. 2009-109905 filed Apr. 28, 2009. The entire contents of the prior applications are incorporated herein by reference.

TECHNICAL FIELD

The present invention relates to an image forming device, such as an electrophotographic type color printer, and an image bearing member unit provided in the image forming device.

BACKGROUND

One electrophotographic type color printer well known in the art is a tandem type color laser printer equipped with four photosensitive drums corresponding to toner of four colors, yellow, magenta, cyan, and black.

One such tandem type color laser printer includes four photosensitive drums, a conveying belt disposed so as to confront the four photosensitive drums, and a belt cleaner for cleaning residual toner deposited on the conveying belt. In this image forming device, the conveying belt is interposed between the belt cleaner and the four photosensitive drums.

SUMMARY

In the conventional image forming device described above, the belt cleaner is positioned on the opposite side of the conveying belt from the photosensitive drums. Hence, in order to perform maintenance on the belt cleaner, firstly all of the four photosensitive drums must be removed, and further, the conveying belt must be removed to access the belt cleaner. The difficulty in accessing the belt cleaner for maintenance is a problematic point in the structure of the image forming device.

In view of the foregoing, it is an object of the present invention to provide a tandem type image forming device capable of facilitating maintenance of a cleaning member as well as to provide an image bearing member unit to be provided in the image forming device.

In order to attain the above and other objects, the present invention provides an image forming device including: a housing; a conveying belt; and a retaining member. The conveying belt is mounted in the housing and is configured to convey a recording medium thereon. The retaining member retains a plurality of image bearing members such that the image bearing members are juxtaposed with one another and that are arranged spaced apart from one another, the retaining member being slidingly movable relative to the housing in a direction that the image bearing members are juxtaposed. The retaining member retains the image bearing members such that the image bearing members confront the conveying belt and such that the image bearing members and the conveying belt are arranged in a reference direction, an image bearing member side and a conveying belt side being defined along the reference direction such that the image bearing members are located on the image bearing member side and the conveying belt is located on the conveying belt side with respect to the reference direction, the image bearing members being configured to form images on the recording medium that is conveyed by the conveying belt. The retaining member includes: a cleaning member that is configured to remove a residual developing agent from the conveying belt; and a guide unit that is configured to guide the recording medium to the conveying belt. The guide unit and the cleaning member are arranged in the reference direction such that the guide unit is located on the image bearing member side and the cleaning member is located on the conveying belt side with respect to the reference direction, at least part of the guide unit overlapping at least part of the cleaning member when projected in the reference direction.

According to another aspect, the present invention provides an image bearing member unit for being slidingly movably provided in a housing of an image forming device, a conveying belt being provided in the housing of the image forming device and being configured to convey a recording medium thereon. The image bearing member unit includes: a plurality of image bearing members; and a retaining member. The plurality of image bearing members is juxtaposed with one another, is arranged spaced apart from one another, and is configured to form images on a recording medium that is conveyed by a conveying belt mounted in a housing of the image forming device. The retaining member is slidingly movable relative to the housing of the image forming device in a direction that the image bearing members are juxtaposed and that retains the image bearing members. The retaining member includes: a cleaning member that is configured so as to be capable of removing a residual developing agent from the conveying belt; and a guide unit that is configured so as to be capable of guiding the recording medium to the conveying belt. The guide unit and the cleaning member are arranged in a reference direction, a guide unit side and a cleaning member side being defined along the reference direction such that the guide unit is located on the guide unit side and the cleaning member is located on the cleaning member side with respect to the reference direction, at least part of the guide unit overlapping at least part of the cleaning member when projected in the reference direction. The retaining member retains the image bearing members at a location such that relative positions among the image bearing members, the guide unit, and the cleaning member defining a conveying belt locating position where the conveying belt is located when the image bearing member unit is mounted in the housing of the image forming device, the image bearing members confronting the conveying belt locating position and the image bearing members and the conveying belt locating position being arranged in the reference direction such that the image bearing members are located on the guide unit side and the conveying belt locating position is located on the cleaning member side with respect to the reference direction.

According to another aspect, the present invention provides an image forming device including: a plurality of photosensitive drums; a first roller and a second roller; a conveying belt; a belt cleaner; and a paper guide. The plurality of photosensitive drums are arranged parallel to and spaced apart from one another in a first direction. The first roller and the second roller are disposed parallel to each other and arranged spaced apart from each other in the first direction. The conveying belt is stretched around the first roller and the second roller, with a top portion of the conveying belt opposing and contacting each of the photosensitive drums from below. The belt cleaner is disposed diagonally above the first roller and in confrontation with the first roller. The paper guide is configured to guide a paper to the conveying belt and is disposed above the belt cleaner so as to overlap the belt cleaner at least partly when projected in an upper-to-lower direction.

According to another aspect, the present invention provides an image forming device including: a conveying belt; a plurality of image bearing members; a cleaning member; and a guide unit. The conveying belt is configured to convey a recording medium thereon. The plurality of image bearing members are juxtaposed with one another and are arranged spaced apart from one another. The image bearing members confront the conveying belt. The image bearing members and the conveying belt are arranged in a reference direction, an image bearing member side and a conveying belt side being defined along the reference direction such that the image bearing members are located on the image bearing member side and the conveying belt is located on the conveying belt side with respect to the reference direction, the image bearing members being configured to form images on the recording medium that is conveyed by the conveying belt. The cleaning member is configured to remove a residual developing agent from the conveying belt. The guide unit is configured to guide the recording medium to the conveying belt, the guide unit and the cleaning member being arranged in the reference direction such that the guide unit is located on the image bearing member side and the cleaning member is located on the conveying belt side with respect to the reference direction, at least part of the guide unit overlapping at least part of the cleaning member when projected in the reference direction.

BRIEF DESCRIPTION OF THE DRAWINGS

The particular features and advantages of the present invention as well as other objects will become apparent from the following description taken in connection with the accompanying drawings, in which:

FIGS. 10A and 10B are explanatory views for explaining an operation of a stopcock shown in FIG. 2, wherein FIG. 10A shows a vertical position of the stopcock in which a shutter is in a closed position, and FIG. 10B shows a horizontal position of the stopcock in which the shutter is in an open position;

FIGS. 13A and 13B are explanatory diagrams for explaining how a roller and a rib provided on the process unit cooperate with a guide rail provided in the main casing when the process unit is being mounted in the main casing, wherein FIG. 13A shows a state of the roller and the rib relative to the guide rail when the process unit is being mounted in the main casing, and FIG. 13B shows a state of the roller and the rib relative to the guide rail when the process unit is completely mounted in the main casing.

DETAILED DESCRIPTION

1. Overall Structure of Color Laser Printer

Next, a color laser printer 1 as an image forming device according to one embodiment of the present invention will be described while referring to the accompanying drawings.

Figure 1:
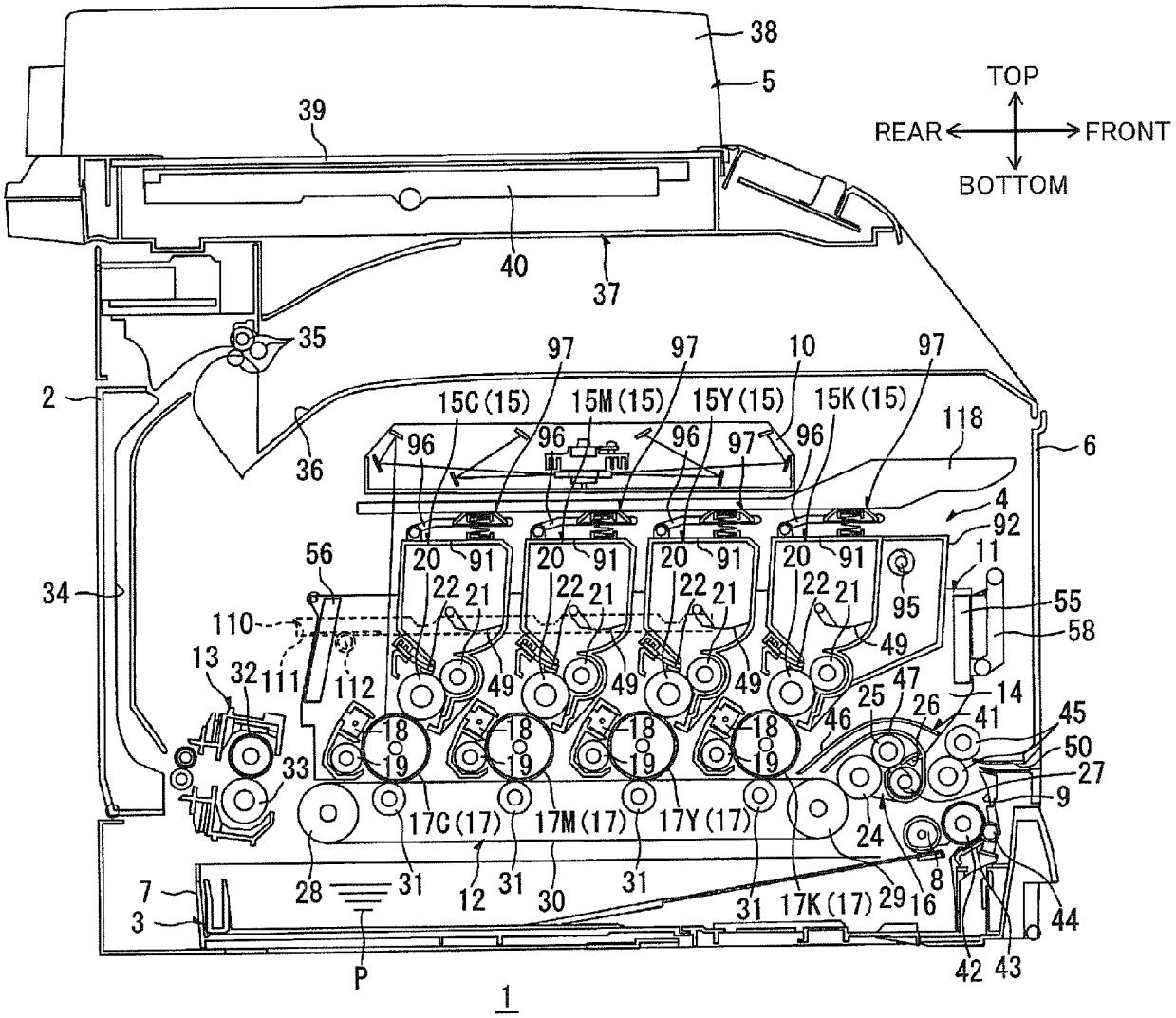
FIG. 1 is a side cross-sectional view of a color laser printer according to one embodiment of the present invention.

As shown in FIG. 1, the color laser printer 1 is a horizontal direct tandem type color laser printer. The color laser printer 1 includes a main casing 2, and, within the main casing 2, a feeding unit 3 for feeding a recording medium (a sheet of paper P in this example), an image forming unit 4 for forming an image on the sheet P conveyed from the feeding unit 3, and an image reading unit 5 for reading image data from an original document. That is, the color laser printer 1 is a multifunction peripheral that is integrally provided with the image forming unit 4 and the image reading unit 5.

(1) Main Casing

The main casing 2 has a box shape that is substantially rectangular in a side view. The feeding unit 3, the image forming unit 4, and the image reading unit 5 are accommodated in the main casing 2. A front cover 6 is provided on one side wall of the main casing 2 in order to mount or remove a process unit 11 described later.

In the following description, the side of the color laser printer 1 on which the front cover is provided (right side in FIG. 1) will be referred to as the front side, and the opposite side (left side in FIG. 1) as the rear side. The left and right sides of the color laser printer 1 will be based on the perspective of a user viewing the color laser printer 1 from the front. Hence, the near side of the color laser printer 1 in FIG. 1 is the left side, and the far side is the right side.

(2) Feeding Unit

The feeding unit 3 includes a paper tray 7 for accommodating the sheet P. The paper tray 7 is detachably mounted in a bottom section of the main casing 2.

Further, the feeding unit 3 includes a feeding roller 8, a separating roller 42, a separating pad 43, a supplementary roller 44, a feeding path 9, and a pair of registration rollers 45.

The feeding roller 8 is disposed above a front end portion of the paper tray 7. The separating roller 42 is disposed in front of the feeding roller 8 and arranged slightly spaced apart from the feeding roller 8 in a front-to-rear direction.

The separating pad 43 is disposed below the separating roller 42 and contacts the separating roller 42 from below. The supplementary roller 44 is disposed in front of the separating roller 42 and contacts the separating roller 42 from front.

The feeding path 9 is disposed above the supplementary roller 44. The feeding path 9 extends upward from a position at which the separating roller 42 confronts the supplementary roller 44, and the feeding path 9 is slightly bent rearward at its upper end portion.

Both of the registration rollers 45 are disposed diagonally above and rearward of the feeding path 9. The registration rollers 45 are in confrontation with each other in an upper-to-lower direction. Specifically, the lower registration roller 45 is disposed slightly rearward of the upper registration roller 45. The upper registration roller 45 is located diagonally above and frontward of the lower registration roller 45. A confronting portion is defined for the registration rollers 45 as a portion where the registration rollers 45 confront with each other. The confronting portion of the registration rollers 45 has a front side edge and a rear side edge. The upper end portion of the feeding path 9 faces the front side edge of the confronting portion of the registration rollers 45, while a front end portion of a paper guide 41 (described later) faces the rear side edge of the confronting portion of the registration rollers 45.

In association with rotation of the feeding roller 8, the topmost sheets P accommodated in the paper tray 7 are conveyed toward a portion where the separating roller 42 confronts the separating pad 43, and the sheets P are separated on a sheet-by-sheet basis by the separating roller 42 and the separating pad 43. Subsequently, while guided by the supplementary roller 44, each sheet P is conveyed to the feeding path 9 from the separating roller 42. Then, while guided by the feeding path 9, the sheet P is conveyed to the confronting portion of the registration rollers 45. After passing between the registration rollers 45, the sheet P is conveyed to pass through the paper guide 41 (described later) and to pass between photosensitive drums 17 (described later) and a conveying belt 30 (described later).

The front cover 6 has a lower end portion at which a manual feeding path 50 is provided. The manual feeding path 50 extends from a front surface of the front cover 6 toward the confronting portion of the registration rollers 45. With this configuration, a user can insert a sheet P into the manual feeding path 50 from the front side in order to feed the sheet P, instead of feeding a sheet P from the feeding unit 3. The manually fed sheet P is guided by the manual feeding path 50 to be conveyed directly to the confronting portion of the registration rollers 45.

(3) Image Forming Unit

The image forming unit 4 includes a scanning unit 10, the process unit 11 (image bearing member unit), a transfer unit 12, and a fixing unit 13.

(3-1) Scanning Unit

The scanning unit 10 is disposed in an upper section of the main casing 2. The scanning unit 10 irradiates laser beams toward four photosensitive drums 17 (described later) based on image data in order to expose the photosensitive drums 17.

(3-2) Process Unit (3-2-1) Structure of Process Unit

The process unit 11 is disposed below the scanning unit 10 and above the transfer unit 12. The process unit 11 includes: a single process frame 14; and four developer cartridges 15 respectively containing toner corresponding to each of the four colors.

The process frame 14 is slidingly movable in the front-to-rear direction relative to the main casing 2.

The process frame 14 retains the photosensitive drums 17, scorotron chargers 18, and drum cleaning rollers 19.

The four photosensitive drums 17 are arranged parallel to and spaced apart from one another in the front-to-rear direction, and are oriented with their shafts 170 (shown in FIG. 2) extending in the left-to-right direction. Specifically, the photosensitive drums 17 include a black photosensitive drum 17K, a yellow photosensitive drum 17Y, a magenta photosensitive drum 17M, and a cyan photosensitive drum 17C arranged in this order from front to rear.

The scorotron chargers 18 are disposed diagonally above and rearward of the respective photosensitive drums 17 and confront but do not contact the photosensitive drums 17.

The drum cleaning rollers 19 are disposed rearward of the respective photosensitive drums 17 and confront and contact the photosensitive drums 17.

The developer cartridges 15 are detachably mounted in the process frame 14 in a juxtaposed state above the corresponding photosensitive drums 17 and confront the corresponding photosensitive drums 17. Specifically, the developer cartridges 15 include a black developer cartridge 15K, a yellow developer cartridge 15Y, a magenta developer cartridge 15M, and a cyan developer cartridge 15C arranged in this order from front to rear. Each of the developer cartridges 15 is also provided with a developing roller 20.

Each developing roller 20 is rotatably supported in a lower end of the corresponding developer cartridge 15 so as to expose a bottom rear edge of the developing roller 20 through a lower edge of the developer cartridges 15. Each of the developing rollers 20 is disposed such that the bottom rear edge of the developing roller 20 contacts a top of the corresponding photosensitive drum 17.

Each of the developer cartridges 15 also includes: a supply roller 21 for supplying toner to the corresponding developing roller 20; and a layer thickness regulating blade 22 for regulating the thickness of the toner supplied to the developing roller 20. The developer cartridge 15 is provided with an agitator 49 for agitating the toner for a corresponding color accommodated in a space formed above the supply roller 21.

(3-2-2) Developing Operation of Process Unit

The toner accommodated in each of the developer cartridges 15 falls downward in association with rotation of the agitator 49 so as to be supplied onto the supply roller 21, which in turn supplies the toner to the developing roller 20. At this time, the toner is positively tribocharged between the supply roller 21 and the developing roller 20.

As the developing roller 20 rotates, the layer thickness regulating blade 22 regulates the toner carried on a surface of the developing roller 20 to a prescribed thickness, so that the developing roller 20 carries a uniform thin layer of toner thereon.

In the meantime, the scorotron charger 18 applies a uniform charge of positive polarity to a surface of the corresponding photosensitive drum 17 while the photosensitive drum 17 rotates. Subsequently, the scanning unit 10 irradiates a laser beam in a high-speed scan in order to form an electrostatic latent image on the surface of the respective photosensitive drum 17 based on image data for a respective color corresponding to an image to be formed on the sheet P.

As the photosensitive drum 17 continues to rotate, the positively charged toner carried on the surface of the developing roller 20 is supplied to the electrostatic latent image formed on the surface of the photosensitive drum 17, thereby developing the electrostatic latent image into a visible toner image through reverse development.

(3-3) Transfer Unit

The transfer unit 12 is disposed in the main casing 2 above the feeding unit 3 and below the process unit 11, and extends in the front-to-rear direction. The transfer unit 12 includes a drive roller 28, a driven roller 29, the conveying belt 30, and four transfer rollers 31.

The drive roller 28 and the driven roller 29 are disposed parallel to each other and arranged spaced apart from each other in the front-to-rear direction. The conveying belt 30 is stretched around the drive roller 28 and the driven roller 29, with a top portion of the conveying belt 30 opposing and contacting each of the photosensitive drums 17 from below. When the drive roller 28 is driven to rotate, the conveying belt 30 circulates in a counterclockwise direction when viewed from the left side so that the top portion of the conveying belt 30 in contact with the photosensitive drums 17 moves rearward for conveying the sheet P rearward.

The transfer rollers 31 are disposed inside the conveying belt 30 at positions opposing corresponding photosensitive drums 17, with the top portion of the conveying belt 30 interposed therebetween. When the sheet P is supplied from the feeding unit 3, the conveying belt 30 conveys the sheet P rearward so that the sheet P passes sequentially through each transfer position between the photosensitive drums 17 and the corresponding transfer rollers 31. As the sheet P is conveyed on the conveying belt 30, the toner images in each color carried on the respective photosensitive drums 17 are sequentially transferred onto the sheet P to form a color image.

In some cases, residual toner remains on peripheral surfaces of the photosensitive drums 17 after the toner images have been transferred onto the sheet P. Therefore, when the residual waste toner is brought opposite the drum cleaning roller 19 by rotation of the photosensitive drum 17, the waste toner is transferred onto a peripheral surface of the drum cleaning roller 19 owing to a cleaning bias applied to the drum cleaning roller 19 and is temporarily retained on the drum cleaning roller 19.

(3-4) Fixing Unit

The fixing unit 13 is disposed rearward of the transfer unit 12 and includes a heating roller 32 and a pressure roller 33 arranged in confrontation with the heating roller 32. While the sheet P passes between the heating roller 32 and the pressure roller 33, the color image transferred onto the sheet P in the transfer unit 12 is thermally fixed to the sheet P by heat and pressure.

(4) Discharge Section

After the toner image has been fixed to the sheet P, the sheet P is conveyed along a U-shaped discharge path 34 toward discharge rollers 35. The discharge rollers 35 discharge the sheet P onto a discharge tray 36 disposed above the scanning unit 10.

(5) Image Reading Unit

The image reading unit 5 is disposed above the discharge tray 36 and includes a document bed 37 and a restraining cover 38 pivotably supported on the document bed 37.

The document bed 37 is formed in a plate shape that is rectangular in a plan view. The document bed 37 has a top surface provided with a glass plate 39 for placing an original document thereon. The document bed 37 also has a built-in CCD sensor 40 disposed below the glass plate 39 for reading the original document placed on the glass plate 39. During an image-reading operation, the CCD sensor 40 is slidably movable in the left-to-right direction while opposing the glass plate 39.

The restraining cover 38 has a rectangular shape in a plan view and functions to cover the document bed 37 from above. The restraining cover 38 is pivotally movable between a closed position in which the restraining cover 38 is horizontal and covers a top surface of the glass plate 39, and an open position in which the restraining cover 38 is erect and exposes the top surface of the glass plate 39.

After the user places the original document on the glass plate 39 of the image reading unit 5 and closes the restraining cover 38, the CCD sensor 40 slidingly moves to read image data of the original document.

Thereafter, the color laser printer 1 is capable of forming an image on the sheet P in the image forming unit 4, as described above, based on the image data of the original document read by the image reading unit 5. The color laser printer 1 also possesses functions for transmitting this image data to a personal computer (not shown) connected to the color laser printer 1 or for transmitting the image data to an external device via a public telephone network.

2. Detailed Description of Process Unit (1) Process Frame

Figure 2:
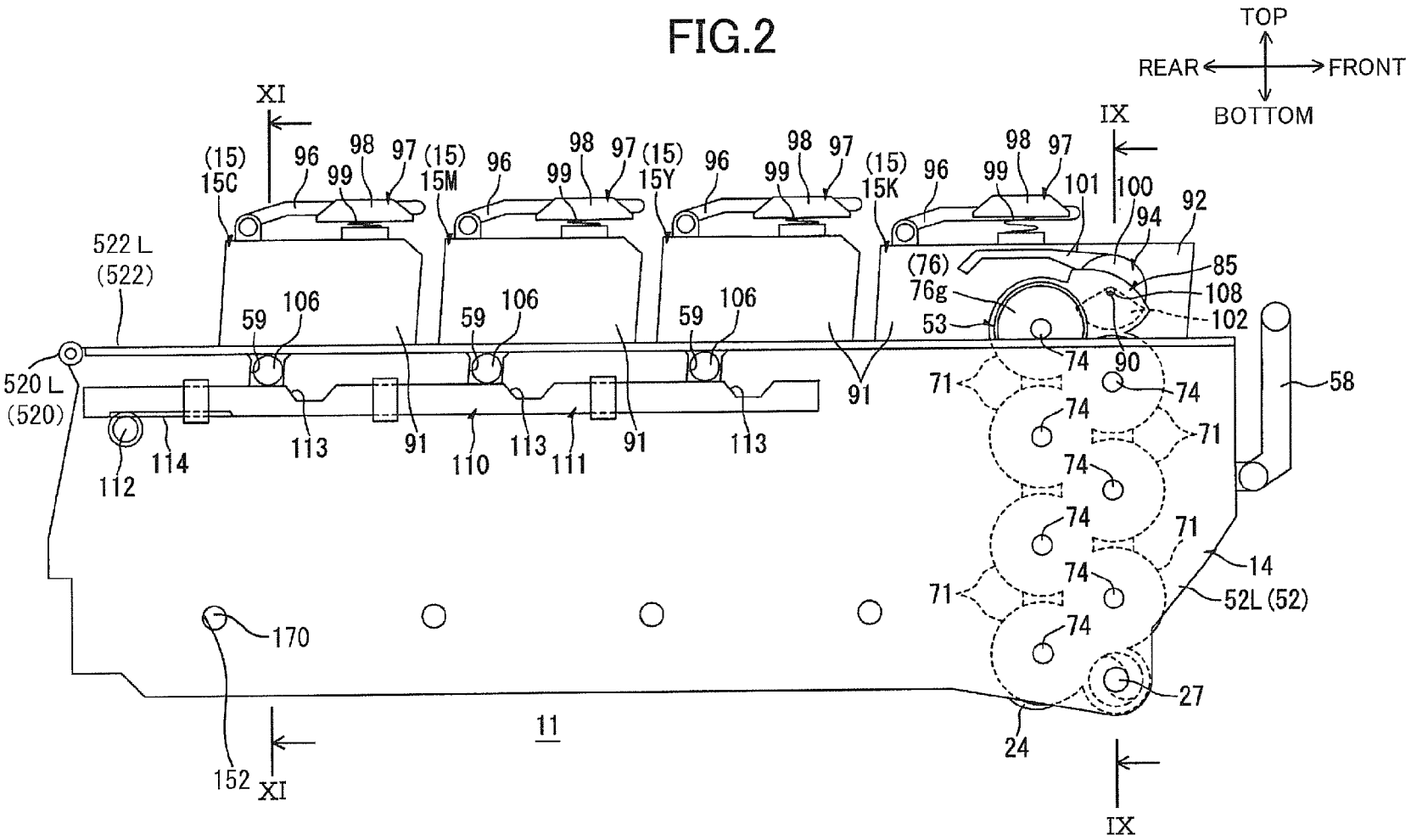
FIG. 2 is a left side view of a process unit shown in FIG. 1.
Figure 3:
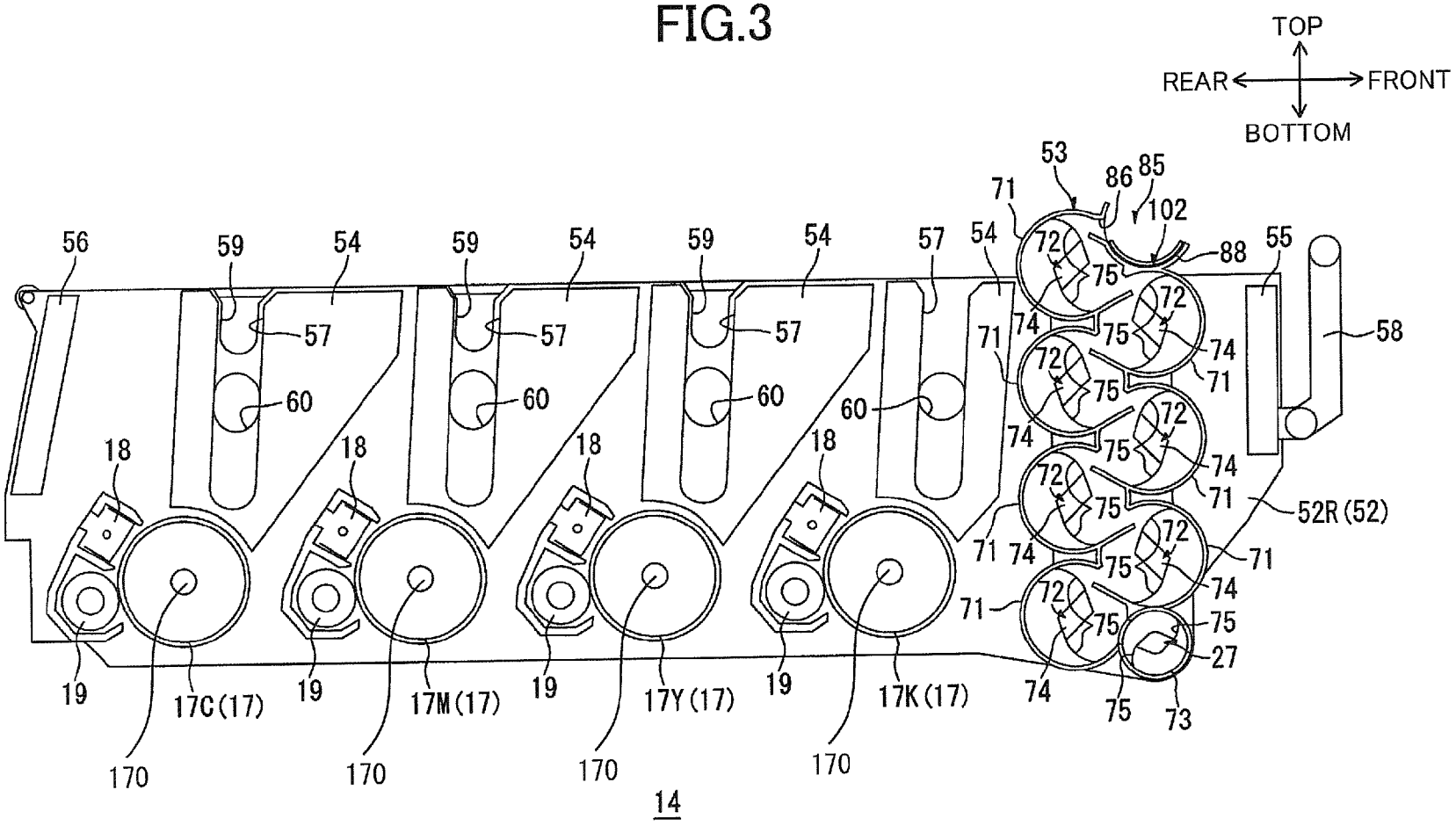
FIG. 3 is a side cross-sectional view of a process frame shown in FIG. 2, taken along a line that extends in the front-to-rear direction and that is located between a right side plate and a left side plate of the process frame and in the vicinity of the left side plate and viewed from the left side.
Figure 9:
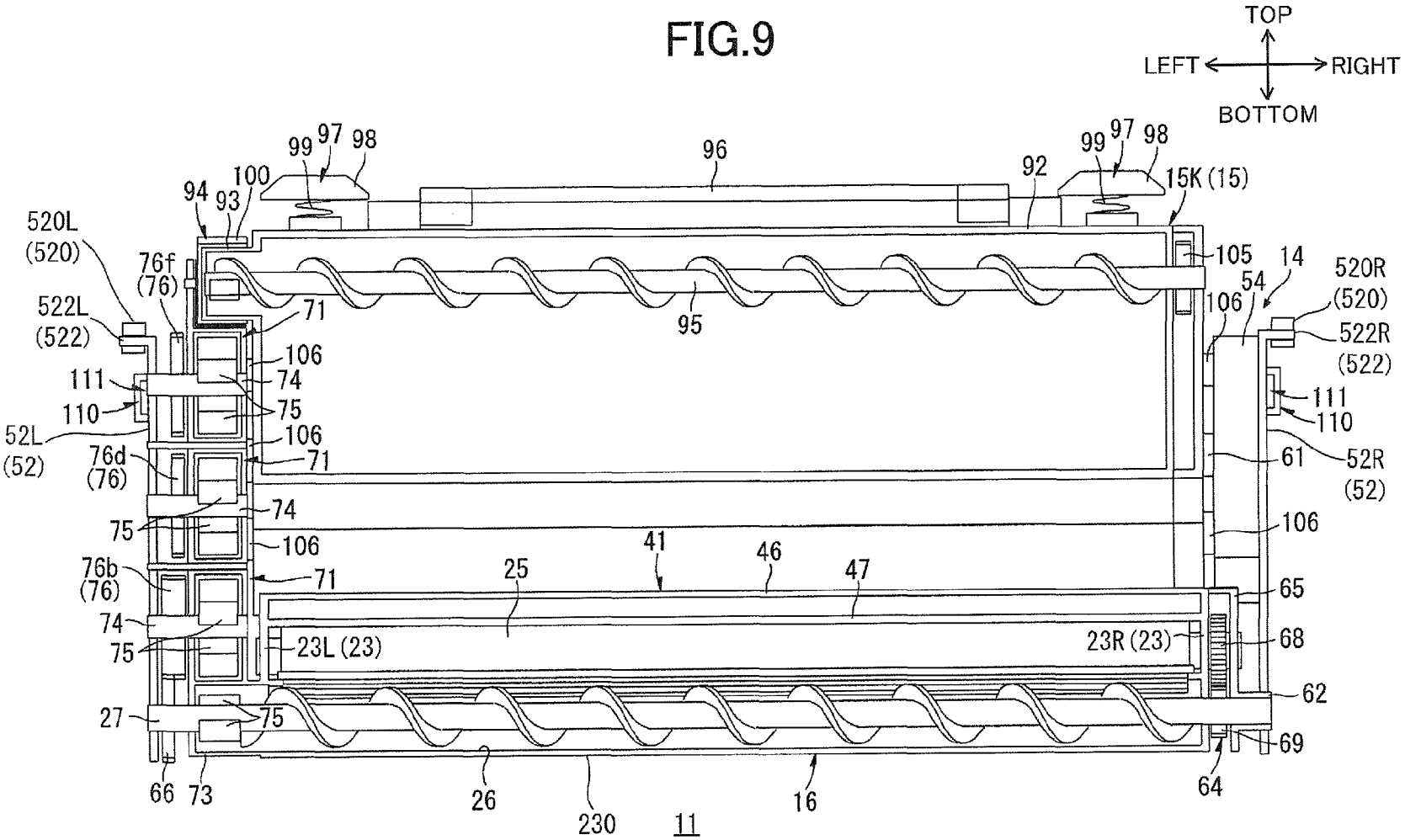
FIG. 9 is a cross-sectional view of the process unit taken along a line IX-IX in FIG. 2, as viewed from a front side thereof.

As shown in FIGS. 2, 3, and 9, the process frame 14 has a bottomless frame shape that is substantially rectangular in a plan view. The process frame 14 includes: a pair of side plates 52 which are arranged spaced apart from each other and in confrontation with each other in the left-to-right direction; a front beam 55; and a rear beam 56.

As shown in FIG. 2, the side plates 52 are plate-shaped and substantially rectangular in a side view. The side plates 52 are elongated in the front-to-rear direction and function to support both longitudinal ends of the shafts 170 of the photosensitive drums 17 so that the photosensitive drums 17 are rotatable relative to the side plates 52. Each side plate 52 is formed with four through-holes 152, through which the longitudinal ends of the shafts 170 of the photosensitive drums 17 are inserted.

Hereinafter, the side plate 52 on the left side will be referred to as a left side plate 52L, and the side plate 52 on the right side will be referred to as a right side plate 52R when it is necessary to distinguish between the two.

As shown in FIGS. 2 and 9, a pair of ribs 522 protrudes from the top edges of the side plates 52 outwardly of the side plates 52 in the left-to-right direction. The ribs 522 are elongated in the front-to-rear direction. The rib 522 on the left side plate 52L will be referred to as a left side rib 522L, and the rib 522 on the right side plate 52R will be referred to as a right side rib 522R when it is necessary to distinguish between the two. A pair of rollers 520 is rotatably supported on rear top edges of the side plates 52. The rollers 520 protrude from the rear top edges of the side plates 52 outwardly of the side plates 52 in the left-to-right direction. The rollers 520 are disposed in the rear side of the ribs 522. The roller 520 on the left side plate 52L will be referred to as a left side roller 520L, and the roller 520 on the right side plate 52R will be referred to as a right side roller 520R when it is necessary to distinguish between the two.

As shown in FIG. 3, support plates 54 are provided on each of the side plates 52 at positions opposing each other in the left-to-right direction. One pair of left and right support plates 54 is provided for each developer cartridge 15. Thus, a total of four pairs of support plates 54 are arranged in the front-to-rear direction. The support plates 54 have flat plate shapes that protrude inward from inner surfaces of the corresponding side plates 52. Each support plate 54 is formed with a cartridge guide groove 57.

Each cartridge guide groove 57 is formed to extend from the top edge of the support plate 54 downward to the position near the corresponding photosensitive drum 17. The cartridge guide grooves 57 are substantially U-shaped in a side view and have an open top. The cartridge guide grooves 57 function to receive cartridge guide ribs 106 (described later) provided on the corresponding developer cartridges 15 in order to guide the developer cartridges 15 when the developer cartridges 15 are mounted in the process frame 14.

Each of the side plates 52 is formed with three cartridge support grooves 59 corresponding to the yellow developer cartridge 15Y, the magenta developer cartridge 15M, and the cyan developer cartridge 15C.

Each of the cartridge support grooves 59 is positioned to overlap the corresponding cartridge guide groove 57 when projected in the left-to-right direction. Each cartridge support groove 59 is formed to penetrate the side plate 52 and extend downward from the top edge thereof to have substantially a U-shape in a side view with an open top. The vertical dimension of the cartridge support groove 59 is shorter than the corresponding cartridge guide groove 57.

The right side plate 52R is formed with four cartridge coupling through-holes 60 at positions overlapping the cartridge guide grooves 57 when projected in the left-to-right direction. The cartridge coupling through-holes 60 penetrate the right side plate 52R. The cartridge coupling through-hole 60 corresponding to the black developer cartridge 15K is formed as a circular through-hole, while the cartridge coupling through-holes 60 corresponding to the yellow developer cartridge 15Y, the magenta developer cartridge 15M, and the cyan developer cartridge 15C are formed as elongated through-holes extending vertically.

When the developer cartridges 15 are mounted in the process frame 14, cartridge coupling portions 61 (described later) provided on the developer cartridges 15 for receiving a drive force are exposed on the right side of the process frame 14 through the cartridge coupling through-holes 60.

The front beam 55 is formed in a plate shape that is substantially rectangular in a front side view. The plate shaped front beam 55 is elongated in the left-to-right direction and spans between front edges of the side plates 52. The front beam 55 has a front surface provided with a frame handle 58. The frame handle 58 is pivotally movable between a horizontal position (shown in FIG. 12) and a vertical position (shown in FIG. 1). The user grips the frame handle 58 when mounting the process frame 14 in or removing the process frame 14 from the main casing 2.

The rear beam 56 is also formed in a plate shape that is substantially rectangular in a front side view. The plate shaped rear beam 56 is elongated in the left-to-right direction and spans between rear edges of the side plates 52.

As shown in FIG. 2, the process frame 14 is provided with a translation cam mechanism 110. The translation cam mechanism 110 includes a pair of left and right translation cams 111, and a pair of left and right translation cam drive gears 112.

The left and right translation cams 111 are provided on the left and right side plates 52, respectively. Each translation cam 111 is in a plate shape elongated in the front-to-rear direction, and slidingly movable in the front-to-rear direction. Each of the translation cams 111 includes three depressions 113 and a rack part 114. The cams 111 are disposed on the outer sides of the side plates 52 in the left-to-right direction.

The depressions 113 are formed in top edges of the translation cams 111 at positions juxtaposed and spaced apart in the front-to-rear direction so as to correspond to the positions of the non-black developer cartridges 15. A front edge of each depression 113 slopes upward toward the front, while a rear edge thereof slopes upward toward the rear.

The rack parts 114 are formed on rear ends of the translation cams 111, extending in the front-to-rear direction along lower edges thereof. The left and right translation cam drive gears 112 are provided on the left and right side plates 52 at positions below the translation cams 111, respectively, and are in engagement with the rack parts 114.

(2) Lift (2-1) Structure of Lift

The process unit 11 is provided with a lift 53 for conveying the waste toner upward. As shown in FIGS. 3 and 9, the lift 53 is fixed to the left side plate 52L at a position on the right side of the left side plate 52L near the front end thereof. That is, the lift 53 is disposed on the right side of the left side plate 52L, and therefore is at the inner side of the side plates 52 in the left-to-right direction.

The lift 53 includes seven lift-side waste toner retaining parts 71, seven blade members 72, a lift-side relaying part 85, a shutter 102, and a lift-side coupling part 73.

As shown in FIG. 3, each of the lift-side waste toner retaining parts 71 is hollow and formed in a substantially columnar shape extending in the left-to-right direction. The lift-side waste toner retaining parts 71 are coupled to each other in a pattern that zigzags from bottom to top, so as to overlap in each other when projected in the front-to-rear direction. More specifically, the seven lift-side waste toner retaining parts 71 are sequentially coupled to one another from bottom to top so that each successive (upper) lift-side waste toner retaining part 71 is coupled to the previous (lower) lift-side waste toner retaining part 71 at a position diagonally above and forward or diagonally above and rearward of the previous lift-side waste toner retaining part 71.

Each of the blade members 72 is provided for one of the lift-side waste toner retaining parts 71, and includes a blade shaft 74 and two blades 75 integrally provided with the blade shaft 74. The blade shaft 74 is inserted into the corresponding lift-side waste toner retaining part 71 and is capable of rotating relative to the lift-side waste toner retaining part 71. The blade shaft 74 protrudes outwardly from the left end of the lift-side waste toner retaining part 71. The blade shaft 74 shares the same central axis as the lift-side waste toner retaining part 71. While not shown in the drawings, a seal is provided between the lift-side waste toner retaining part 71 and the blade shaft 74 for preventing toner leakage.

In each lift-side waste toner retaining part 71, two blades 75 are integrally provided with the blade shaft 74 and extend radially outward from the blade shaft 74. The length of the blades 75 in the radial direction of the blade shaft 74 is set so that the distal ends of the blades 75 contact the inner peripheral surface of the lift-side waste toner retaining part 71. The width of the blades 75 in the left-to-right direction is substantially equivalent to the interior dimension of the lift-side waste toner retaining part 71 in the left-to-right direction.

Figure 4:
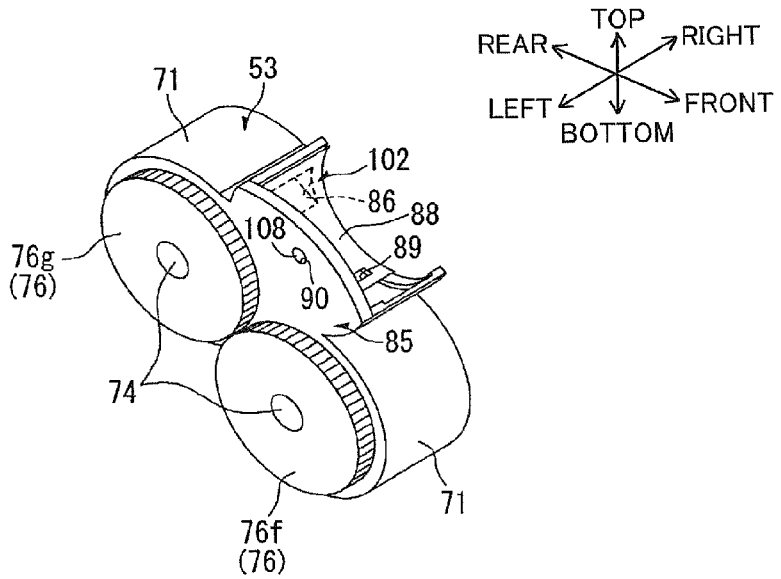
FIG. 4 is a perspective view showing a top portion of a lift shown in FIG. 3.

The lift-side relaying part 85 is disposed diagonally above and frontward of the topmost lift-side waste toner retaining part 71 and is substantially U-shaped in a cross section, opening in a direction diagonally upward and frontward. As shown in FIG. 4, the lift-side relaying part 85 is formed with a lift-side communication port 86 at its rear end. The lift-side communication port 86 is substantially rectangular in a front view and communicates with the topmost lift-side waste toner retaining part 71. The lift-side relaying part 85 is formed with a shutter support through-hole 90 at its left side wall. The shutter support through-hole 90 penetrates the left side wall of the lift-side relaying part 85 in the left-to-right direction and functions to receive a support boss 108 (described later) provided on the shutter 102. The lift-side relaying part 85 receives a shutter section 100 of a stopcock 94 described later on the top side thereof.

Figure 5:
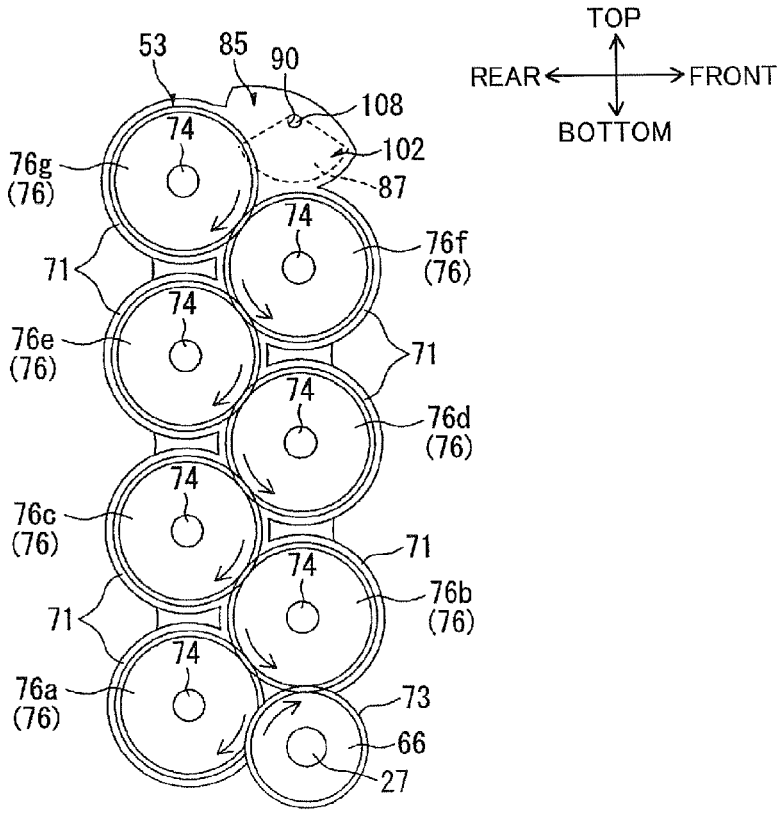
FIG. 5 is an explanatory view for explaining how the lift shown in FIG. 3 transmits a drive force.

As shown in FIGS. 4 and 5, the shutter 102 is formed in a partially cylindrical shape and is substantially sector-shaped in a side view. Specifically, the shutter 102 is integrally provided with a support section 87 that is substantially sector-shaped in a side view, with a center angle of approximately 120 degrees, the support boss 108 that protrudes leftward from the center point of the center angle formed by the support section 87, and a cover section 88 extending rightward from an arcuate-shaped edge of the support section 87. The shutter 102 is formed with a fitting through-hole 89 at a front edge of the cover section 88. The fitting through-hole 89 extends in the left-to-right direction and receives a fitting protrusion 107 (described later).

The shutter 102 is accommodated in the lift-side relaying part 85 such that the support boss 108 is rotatably inserted in the shutter support through-hole 90 and an outer surface of the cover section 88 confronts an inner surface of the lift-side relaying part 85. With this configuration, the shutter 102 is pivotally movable about the support boss 108 between a closed position (shown in FIG. 10A) in which a rear end of the cover section 88 confronts the lift-side communication port 86 and an open position (shown in FIG. 10B) in which the rear end of the cover section 88 is disposed below the lift-side communication port 86.

As shown in FIG. 3, the lift-side coupling part 73 is disposed diagonally below and frontward of the bottommost lift-side waste toner retaining part 71 and fluid communication is provided between the inside of the lift-side coupling part 73 and the inside of the bottommost lift-side waste toner retaining part 71. The lift-side coupling part 73 has a cylindrical hollow shape with a slightly smaller diameter than that of each lift-side waste toner retaining part 71. The lift-side coupling part 73 is opened on the right side and rotatably supports a left end of a first screw 27 (described later) so as to share its axis with the first screw 27.

A portion of the first screw 27 near to its left end is disposed within the inside of the lift-side coupling part 73. A blade 75 is integrally provided on the first screw 27 at its portion that is disposed within the lift-side coupling part 73.

(2-2) Drive Force Transmission Mechanism of Lift

The lift 53 is provided with seven blade gears 76 in correspondence with the seven lift-side waste toner retaining parts 71, respectively, as shown in FIG. 5.

As shown in FIG. 9, each blade gear 76 is disposed between the left side plate 52L and the lift 53, and is disposed at the left side of the corresponding lift-side waste toner retaining part 71. Each blade gear 76 is provided at a left end of one blade shaft 74 and is non-rotatable relative to the blade shaft 74.

As shown in FIG. 5, the blade gears 76 include a bottommost first blade gear 76*a*, a second blade gear 76*b*, a third blade gear 76*c*, a fourth blade gear 76*d*, a fifth blade gear 76*e*, a sixth blade gear 76*f*, and a seventh blade gear 76*g*. The second blade gear 76*b* is disposed adjacent to the first blade gear 76*a* at a position diagonally above and frontward therefrom. The third blade gear 76*c* is disposed adjacent to the second blade gear 76*b* at a position diagonally above and rearward therefrom. The fourth blade gear 76*d* is disposed adjacent to the third blade gear 76*c* at a position diagonally above and frontward therefrom. The fifth blade gear 76*e* is disposed adjacent to the fourth blade gear 76*d* at a position diagonally above and rearward therefrom. The sixth blade gear 76*f* is disposed adjacent to the fifth blade gear 76*e* at a position diagonally above and frontward therefrom. The seventh blade gear 76*g* is disposed adjacent to the sixth blade gear 76*f* at a position diagonally above and rearward therefrom. The second blade gear 76*b* is formed more than twice as long in the left-to-right direction as the other blade gears 76 as shown in FIG. 9.

A left edge of the second blade gear 76*b* is engaged with a first screw gear 66 (described later). A right edge of the second blade gear 76*b* is engaged with both of the first blade gear 76*a* and the third blade gear 76*c*. The third blade gear 76*c* is engaged with the fourth blade gear 76*d*. The fourth blade gear 76*d* is engaged with the fifth blade gear 76*e*. The fifth blade gear 76*e* is engaged with the sixth blade gear 76*f*. The sixth blade gear 76*f* is engaged with the seventh blade gear 76*g*.

(3) Belt Cleaner and Paper Guide

The process unit 11 also includes: a belt cleaner 16 that is provided for removing waste toner deposited on the surface of the conveying belt 30; and the paper guide 41.

Figure 6:
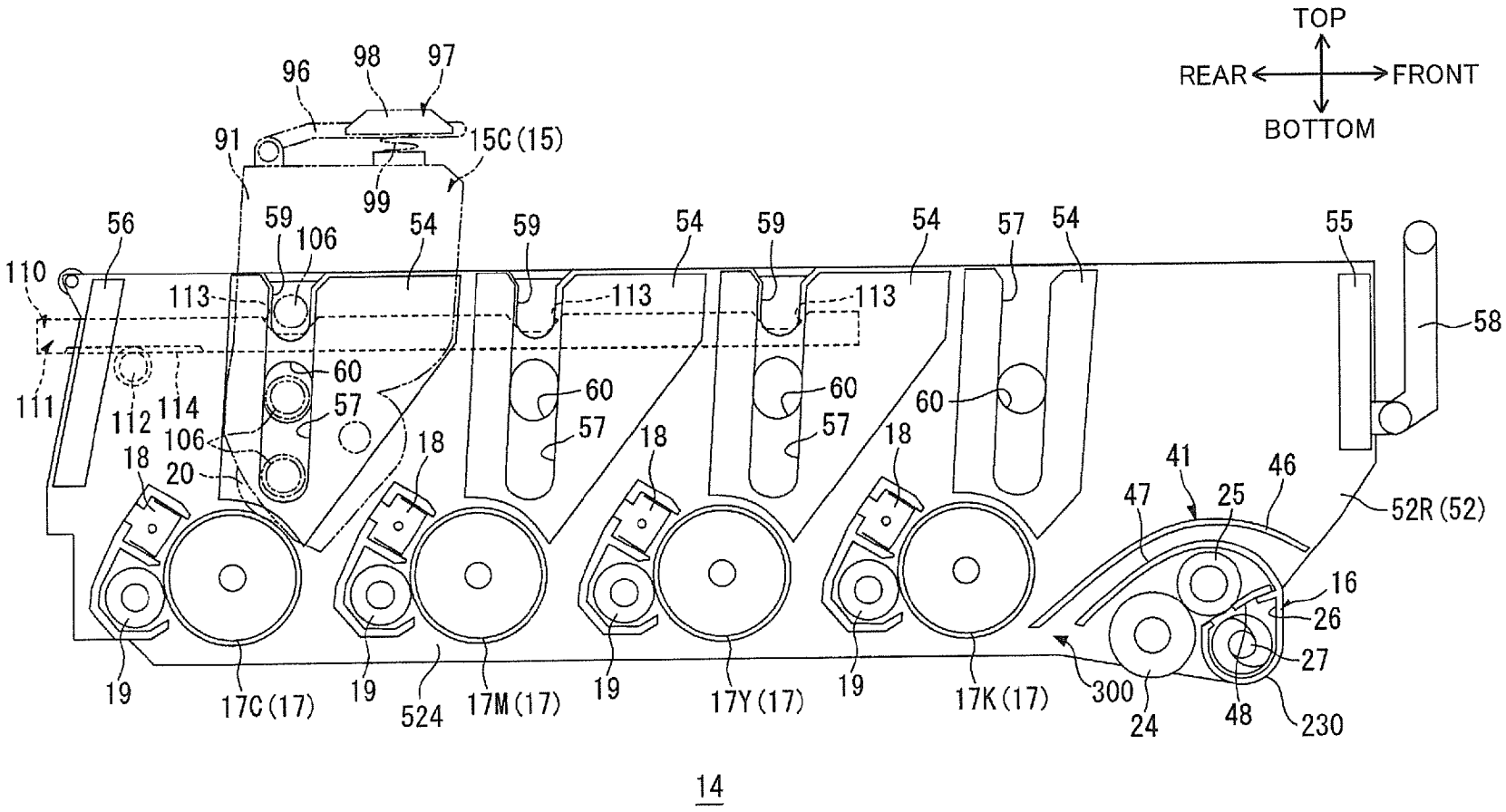
FIG. 6 is a side cross-sectional view of the process frame shown in FIG. 2, taken along a line that extends in the front-to-rear direction and that is located on a substantial center of the process frame in a right-to-left direction and viewed from the left side.

As shown in FIGS. 1 and 6, the belt cleaner 16 includes a belt cleaning roller 24, a relay roller 25, a scraper 48, a cleaner-side waste toner retaining section 26, and the first screw 27.

As shown in FIG. 9, the belt cleaner 16 further includes a gear cover 65, a gear train 64, and a screw shaft bearing 62 at its right side end. The belt cleaner 16 is integrally connected to the lift-side coupling part 73 of the lift 53 at its left side end.

A pair of cleaner side plates 23 and a partition wall 230 are provided between the side plates 52 in the left-to-right direction as shown in FIGS. 6 and 9. As shown in FIG. 9, the cleaner side plates 23 include a right cleaner side plate 23R and a left cleaner side plate 23L. The right cleaner side plate 23R is located on the left side of the right side plate 52R and spaced apart from the right side plate 52R in the left-to-right direction. The left cleaner side plate 23L is located on the right side of the left side plate 52L and spaced apart from the left side plate 52L in the left-to-right direction. The cleaner side plates 23 are arranged spaced apart from each other and in confrontation with each other in the left-to-right direction. The left cleaner side plate 23L is cut out at its front lower edge, and is integrally connected with the right-side edge (opened edge) of the lift-side coupling part 73 of the lift 53. Thus, the left cleaner side plate 23L is supported by the left side plate 52 via the lift-side coupling part 73. As shown in FIG. 6, the partition wall 230 is formed in a substantially cylindrical shape with an open top and extends in the left-to-right direction. The partition wall 230 is integrally connected at its right end with the right cleaner side plate 23R and at its left end with the left cleaner side plate 23L and the right side edge of the lift-side coupling part 73. The cleaner-side waste toner retaining section 26 is defined as the space surrounded by the right cleaner side plate 23R and the partition wall 230 as shown in FIGS. 6 and 9, and is in fluid communication with the inside of the lift-side coupling part 73 at its left side edge.

The first screw 27 extends in the left-to-right direction, and is partly disposed inside the cleaner-side waste toner retaining section 26 and is partly disposed inside the lift-side coupling part 73. More specifically, the left end of the first screw 27 protrudes outside of the lift-side coupling part 73 from the left side end of the lift-side coupling part 73. The right end of the first screw 27 protrudes outside of the cleaner-side waste toner retaining section 26 from the right cleaner side plate 23R. The portion of the first screw 27 near to its left end is disposed inside the lift-side coupling part 73. A remaining part of the first screw 27 is disposed in the inside of the cleaner-side waste toner retaining section 26.

The first screw 27 has a peripheral surface formed with a right-hand thread. As shown in FIG. 9, the first screw gear 66 is provided at the left end of the first screw 27 that protrudes outside of the lift-side coupling part 73. The first screw gear 66 is non-rotatable relative to the first screw 27. The first screw gear 66 is located at a position between the left side plate 52L and the lift-side coupling part 73 and is engaged with the left edge of the second blade gear 76*b*.

As shown in FIG. 6, the scraper 48 is provided on the upper front edge of the partition wall 230. The scraper 48 is formed of rubber and has a plate shape extending in the left-to-right direction. The scraper 48 extends rearward from the upper front edge of the partition wall 230. The scraper 48 covers a front half of the open top of the cleaner-side waste toner retaining section 26 from above. The scraper 48 has a rear end that contacts a lower edge of the relay roller 25 from below.

The belt cleaning roller 24 is rotatably supported by the cleaner side plates 23 and extends in the left-to-right direction. The belt cleaning roller 24 is located between the cleaner side plates 23, and accordingly between the side plates 52. A lower end of the belt cleaning roller 24 is exposed beneath the cleaner side plates 23 and the side plates 52. When the process unit 14 is mounted in the color laser printer 1, the belt cleaning roller 24 is disposed diagonally above and frontward of the driven roller 29 and in confrontation with the driven roller 29. The belt cleaning roller 24 contacts, at its lower rear edge, a part of the conveying belt 30 that is stretched around the driven roller 29.

The relay roller 25 is also rotatably supported by the cleaner side plates 23 and extends in the left-to-right direction. The relay roller 25 is located between the cleaner side plates 23, and accordingly between the side plates 52. The relay roller 25 is disposed at a position diagonally above and frontward from the belt cleaning roller 24 and is in contact with the belt cleaning roller 24.

The gear cover 65 is fixed to the right side surface of the right cleaner side plate 23R. That is, the gear cover 65 is disposed on the outer side of the cleaner side plates 23 in the left-to-right direction. The gear train 64 is disposed inside the gear cover 65. The gear train 64 has a plurality of gears. Specifically, the gear train 64 includes a gear (not shown) disposed at a right end of the first screw 27, a relay roller gear 68 disposed at a right end of the relay roller 25, a cleaning roller gear 69 disposed at a right end of the belt cleaning roller 24, and gears (not shown) for coupling these gears. The gear train 64 transmits a drive force from the first screw 27 to the relay roller 25 and the belt cleaning roller 24.

The screw shaft bearing 62 is cylindrical in shape and protrudes continuously rightward from the right surface of the gear cover 65. The screw shaft bearing 62 rotatably supports the right end of the first screw 27. The right end of the screw shaft bearing 65 is fixed to the right side plate 52R. Thus, the right cleaner side plate 23R is supported by the right side plate 52R via the gear cover 65 and the screw shaft bearing 62.

As shown in FIGS. 6 and 9, the paper guide 41 is disposed above the belt cleaner 16 at a lower front end of the process frame 14. The paper guide 41 is integrally provided with the belt cleaner 16 so as to overlap the belt cleaner 16 at least partly when projected in the upper-to-lower direction.

The paper guide 41 includes a lower guide wall 47 and an upper guide wall 46.

The lower guide wall 47 spans between upper portions of the cleaner side plates 23. In other words, the lower guide wall 47 is located between the cleaner side plates 23 and accordingly between the side plates 52. The lower guide wall 47 is curved and substantially V-shaped in a side view, opening in a direction downward.

Specifically, as shown in FIG. 6, the lower guide wall 47 has a front end portion continuous to the upper front edge of the partition wall 230, that is, the upper front edge of the cleaner-side waste toner retaining section 26. The lower guide wall 47 extends diagonally above and rearward from its front end portion, and curves downward at a position above the relay roller 25 so as to cover the belt cleaning roller 24, the relay roller 25 and the cleaner-side waste toner retaining section 26 from above. The lower guide wall 47 has a rear end portion disposed rearward of the belt cleaning roller 24. When the process unit 11 is mounted in the printer 1, the front end portion of the lower guide wall 47 is disposed rearward of the confronting portion of the registration rollers 45 and the rear end portion of the lower guide wall 47 is in confrontation with the front top portion of the conveying belt 30 in the upper-to-lower direction.

The upper guide wall 46 spans between upper edges of the cleaner side plates 23. In other words, the upper guide wall 46 is located between the cleaner side plates 23 and accordingly between the side plates 52. The upper guide wall 46 is disposed above the lower guide wall 47 and spaced apart from the lower guide wall 47. The upper guide wall 46 is curved and has a substantially V-shape in a side view, opening in a direction downward, so as to cover the lower guide wall 47 from above.

Specifically, the upper guide wall 46 is curved along the curved shape of the lower guide wall 47 so as to confront the lower guide wall 47 almost entirely from its front end portion to its rear end portion and so as to be equally-spaced apart from the lower guide wall 47 almost entirely from its front end portion to its rear end portion. The distance between the front end portion of the upper guide wall 46 and the front end portion of the lower guide wall 47 is greater than the distance between the rear end portion of the upper guide wall 46 and the rear end portion of the lower guide wall 47. When the process unit 11 is mounted in the printer 1, the front end portion of the upper guide wall 46 is disposed rearward of the upper registration roller 45 and above the lower registration roller 45. The rear end portion of the upper guide wall 46 is disposed between the black photosensitive drum 17K and the rear end portion of the lower guide wall 47 in the front-to-rear direction. The rear end portion of the upper guide wall 46 is disposed in confrontation with the front top portion of the conveying belt 30 in the upper-to-lower direction.

Figure 12:
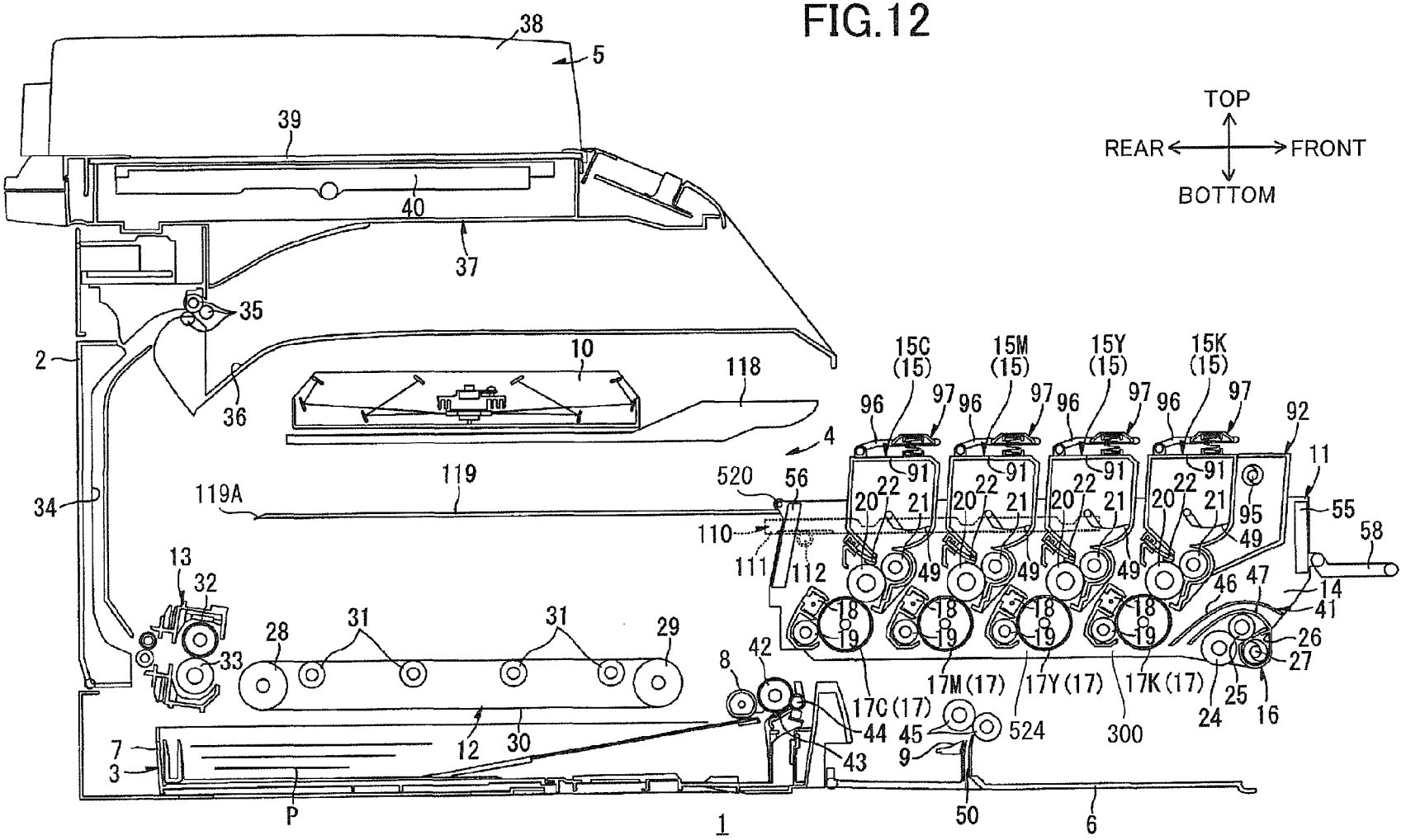
FIG. 12 is an explanatory diagram for explaining how to mount the process unit in a main casing, showing a state prior to mounting the process unit in the main casing.

In the process unit 11 having the configuration described above, the belt cleaner 16 and the paper guide 41 are provided between the side plates 52 in the left-to-right direction, and the lift 53 is located between the left side plate 52L and the paper guide 41 in the left-to-right direction. As shown in FIGS. 6 and 12, the relative positions among the photosensitive drums 17, the paper guide 41, and the belt cleaner 16 define a conveying belt locating position 300 where the conveying belt 30 will be located when the process unit 11 is mounted in the main casing 2. The conveying belt locating position 300 is defined relative to the photosensitive drums 17, the paper guide 41, and the belt cleaner 16 such that the photosensitive drums 17 are located on the upper side of the conveying belt locating position 300, the paper guide 41 is located on the upper front side of the conveying belt locating position 300, and the belt cleaner 16 is located on the upper front side of the conveying belt locating position 300. The position where the paper guide 41 is exposed to the conveying belt locating position 300 is disposed between the position where the photosensitive drums 17 are exposed to the conveying belt locating position 300 and the position where the belt cleaner 16 is exposed to the conveying belt locating position 300 along the conveying belt moving direction. This ensures that when the conveying belt 30 located in the conveying belt locating position 300 moves in the conveying direction (counterclockwise direction in FIG. 1), the paper guide 41 guides the recording medium P to a position on the conveying belt 30, the position being downstream in the conveying direction from the cleaning position on the conveying belt 30, at which the belt cleaner 16 removes the residual toner from the conveying belt 30, and being upstream in the conveying direction from the confronting positions on the conveying belt 30, at which the photosensitive drums 17 confront the conveying belt 30. Additionally, in the example described above, the side plates 52 have lower portions 524 that are positioned in the lower side of the photosensitive drums 17 and the rear end of the paper guide 41 in the vertical direction. An upper part of the conveying belt 30 is located between the lower portions 524 of the side plates 52 in the left-to-right direction when the process unit 11 is mounted in the main casing 2.

(4) Developer Cartridge

Figure 7A:
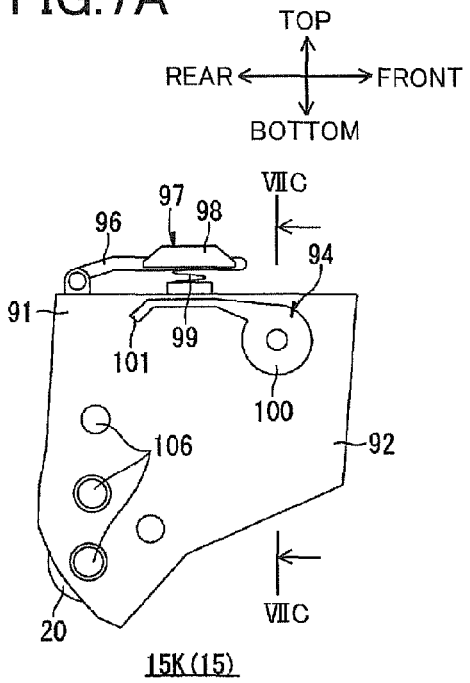
FIG. 7A is a left side view of a black developer cartridge shown in FIG. 2.
Figure 7B:
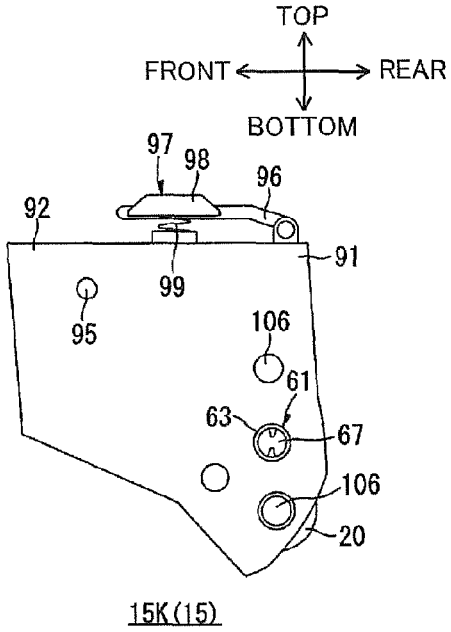
FIG. 7B is a right side view of the black developer cartridge shown in FIG. 2.
Figure 7C:
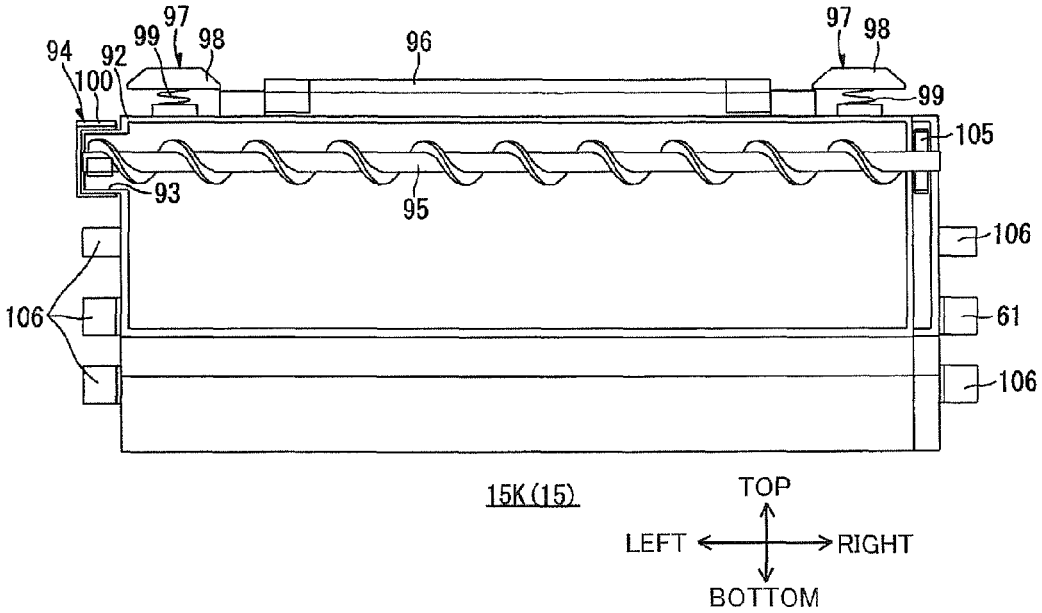
FIG. 7C is a cross-sectional view of the black developer cartridge taken along a line VIIC-VIIC in FIG. 7A, as viewed from a front side thereof.
Figure 8A:
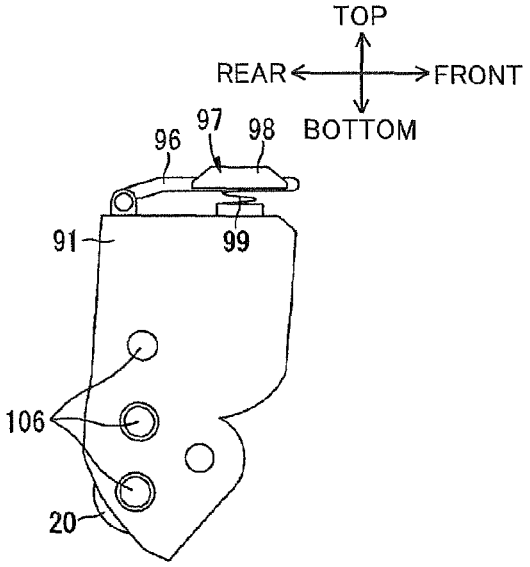
FIG. 8A is a left side view of a color developer cartridge shown in FIG. 2.
Figure 8B:
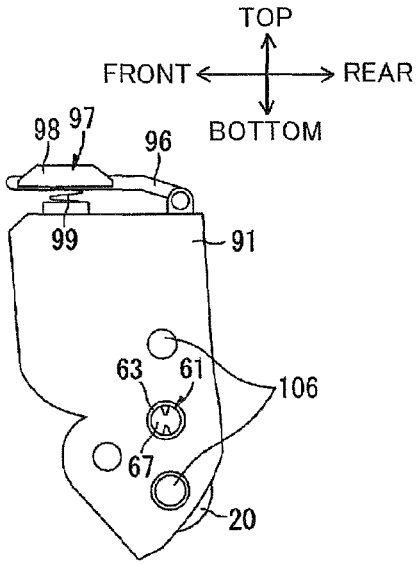
FIG. 8B is a right side view of the color developer cartridge shown in FIG. 2.
Figure 8C:
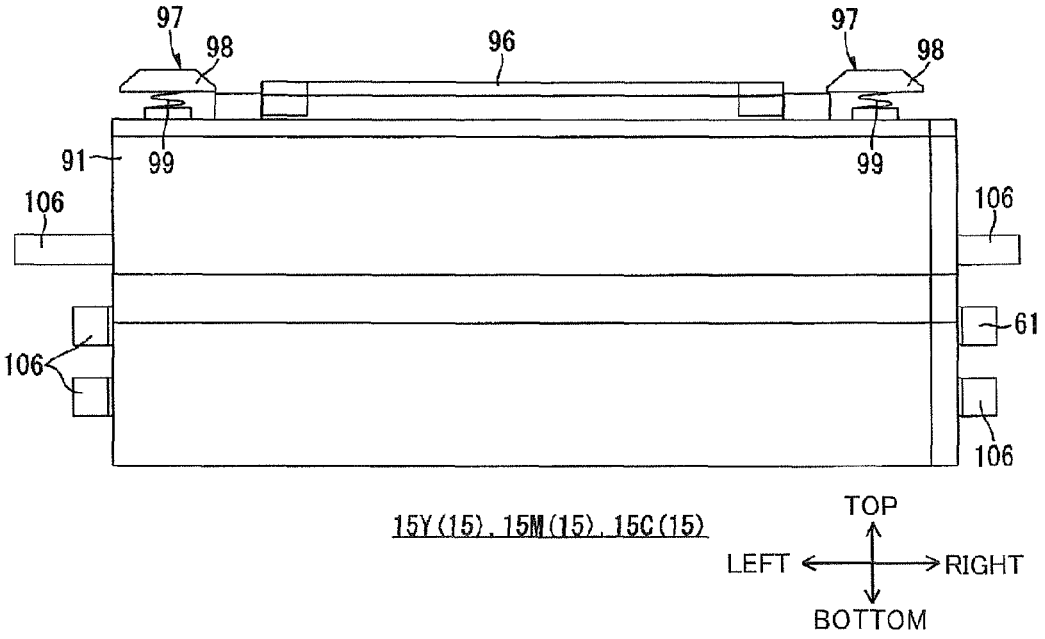
FIG. 8C is a front elevation view of the color developer cartridge shown in FIG. 2.

As shown in FIGS. 1 and 7C, the black developer cartridge 15K is formed in a box shape that is elongated in the left-to-right direction. The black developer cartridge 15K includes a developer case 91.

The developer case 91 is formed in a box shape that is elongated in the left-to-right direction. The developer case 91 has a lower portion in which the developing roller 20, the supply roller 21, and the layer thickness regulating blade 22 are supported. The developer case 91 has an upper portion in which toner is accommodated and the agitator 49 for agitating the toner is provided.

As shown in FIGS. 7A and 7B, the developer case 91 also includes a cartridge handle 96, a pair of left and right urging members 97, the cartridge guide ribs 106, and the cartridge coupling portion 61.

The cartridge handle 96 is provided on a top surface of the developer case 91. The user grips the cartridge handle 96 when mounting the black developer cartridge 15K to the process frame 14 or removing the black developer cartridge 15K from the process frame 14.

The urging members 97 are disposed on the top surface of the developer case 91 and are spaced apart from each other in the left-to-right direction, with one urging member 97 on either side of the cartridge handle 96 (shown in FIG. 7C). Each urging member 97 is configured of a substantially disc-shaped contact member 98, and a compression spring 99 disposed between the contact member 98 and the top surface of the developer case 91. The compression spring 99 has an upper end that is coupled to the contact member 98 and a lower end that is coupled to the top surface of the developer case 91. Accordingly, the contact member 98 is constantly urged upward by the compression spring 99.

The cartridge guide ribs 106 are cylindrical in shape and protrude outward in the left-to-right direction from left and right surfaces of the developer case 91. As shown in FIG. 7A, three cartridge guide ribs 106 are arranged spaced apart from one another and juxtaposed vertically on the left surface of the developer case 91. As shown in FIG. 7B, two cartridge guide ribs 106 are arranged spaced apart from each other and juxtaposed vertically on the right surface of the developer case 91. All the cartridge guide ribs 106 are formed to have the same length in the left-to-right direction.

The topmost cartridge guide rib 106 on the left surface of the developer case 91 shares the same central axis as the upper cartridge guide rib 106 of the right surface of the developer case 91. The bottommost cartridge guide rib 106 on the left surface of the developer case 91 shares the same central axis as the lower cartridge guide rib 106 of the right surface of the developer case 91. The middle cartridge guide rib 106 on the left surface of the developer case 91 shares the same central axis as the cartridge coupling portion 61.

The cartridge coupling portion 61 is disposed between the upper cartridge guide rib 106 and the lower cartridge guide rib 106 in the upper-to-lower direction, and protrudes rightward from the right surface of the developer case 91. The cartridge coupling portion 61 has the same length in the left-to-right direction as the cartridge guide ribs 106. The cartridge coupling portion 61 includes a coupling cover 63 and a cartridge coupling member 67 rotatably provided within the coupling cover 63.

The coupling cover 63 has a cylindrical shape and protrudes rightward from the right surface of the developer case 91.

The developer case 91 is formed with a waste toner accommodating section 92 at its front portion. The waste toner accommodating section 92 is formed in the developer case 91 in the form of a chamber. The developer case 91 is further provided with an accommodating-section-side relay part 93, the stopcock 94, and a second screw 95.

The accommodating-section-side relay part 93 is integrally formed with the case 91 at its upper portion. The accommodating-section-side relay part 93 is cylindrical in shape and protrudes leftward from the left side of the developer case 91. The accommodating-section-side relay part 93 is hollow, and the inside of the accommodating-section-side relay part 93 is in fluid communication with the inside of the waste toner accommodating section 92 in the left-to-right direction. Further, the accommodating-section-side relay part 93 is formed with an accommodating-section-side communication port 104 at its rear left side (shown in FIG. 10A). The accommodating-section-side communication port 104 penetrates the rear side wall of the accommodating-section-side relay part 93 in the front-to-rear direction.

Figure 10A:
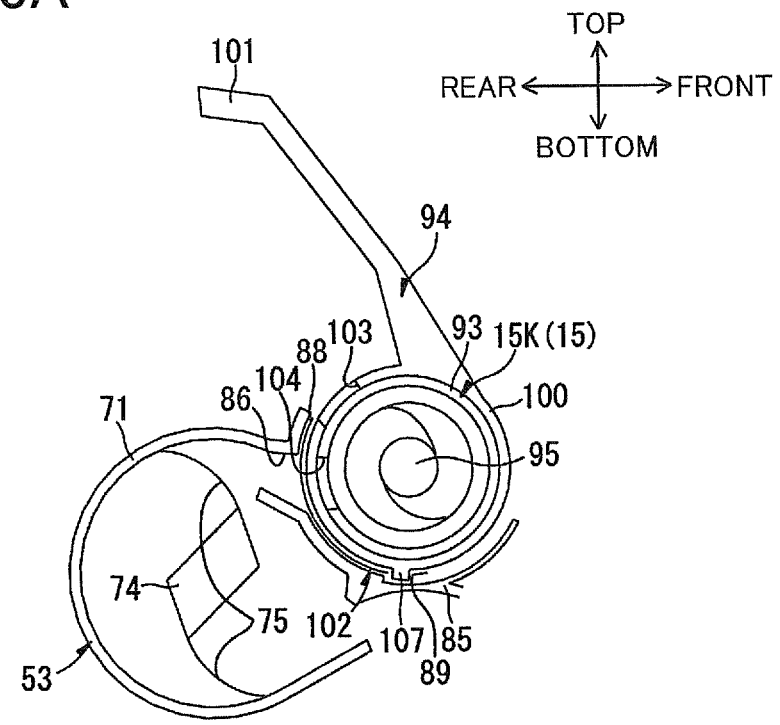

As shown in FIGS. 7A and 10A, the stopcock 94 is pivotally movably provided on a left end portion of the accommodating-section-side relay part 93. The stopcock 94 includes the shutter section 100 and a grip part 101.

The shutter section 100 constitutes a front portion of the stopcock 94. The shutter section 100 has a hollow cylindrical shape that is open on a right side. The shutter section 100 of the stopcock 94 is rotatably fitted around the left end portion of the accommodating-section-side relay part 93. The shutter section 100 is formed with the fitting protrusion 107 (shown in FIG. 10A) in opposition to the grip part 101 in a radial direction thereof.

The fitting protrusion 107 protrudes radially outward from an outer peripheral surface of the shutter section 100 and extends in the left-to-right direction.

The grip part 101 has a flat plate shape that is substantially rectangular in a plan view. The grip part 101 is formed continuously with a top edge of the shutter section 100 and extends rearward therefrom. In a side view, the grip part 101 has a rear end portion that is bent downward toward the rear side.

An operating-part-side communication port 103 is formed in the shutter section 100 at a position below the grip part 101 and penetrates the shutter section 100 in the front-to-rear direction (shown in FIG. 10A).

The stopcock 94 is movable between a horizontal position in which the shutter section 100 is in an open position (shown in FIG. 10B) for allowing fluid communication between the accommodating-section-side relay part 93 and the lift 53, and a vertical position in which the shutter section 100 is in a closed position (shown in FIG. 10A) for prohibiting fluid communication between the accommodating-section-side relay part 93 and the lift 53.

As shown in FIG. 7C, the second screw 95 is disposed inside the waste toner accommodating section 92. More specifically, the second screw 95 is disposed in an upper portion of the waste toner accommodating section 92 with its axis extending in the left-to-right direction and common to the axis of the accommodating-section-side relay part 93. The right side end of the second screw 95 is rotatably supported by the casing 91 on the right side of the waste toner accommodating section 92. The left side end of the second screw 95 is rotatably supported by the casing 91, more specifically, by the left end of the accommodating-section-side relay part 93. The second screw 95 has an outer peripheral surface on which a right-hand thread is formed.

A second screw gear 105 is provided on the right end of the second screw 95 in the right side of the waste toner accommodating section 92. The second screw gear 105 is non-rotatable relative to the second screw 95. When a drive force generated on the main casing 2 side is inputted into the cartridge coupling portion 61, this drive force is transmitted to the second screw gear 105 via a gear train (not shown), driving the second screw gear 105, driving the second screw gear 105 to rotate counterclockwise in a left side view.

As shown in FIGS. 1 and 8A-8C, the non-black developer cartridges 15 (hereinafter referred to as "color developer cartridges 15") are formed similar to the black developer cartridge 15K, except that each of the color developer cartridges 15 is not provided with the waste toner accommodating section 92 and that the topmost cartridge guide ribs 106 on both sides are formed longer than the topmost cartridge guide ribs 106 of the black developer cartridge 15K.

Figure 11:
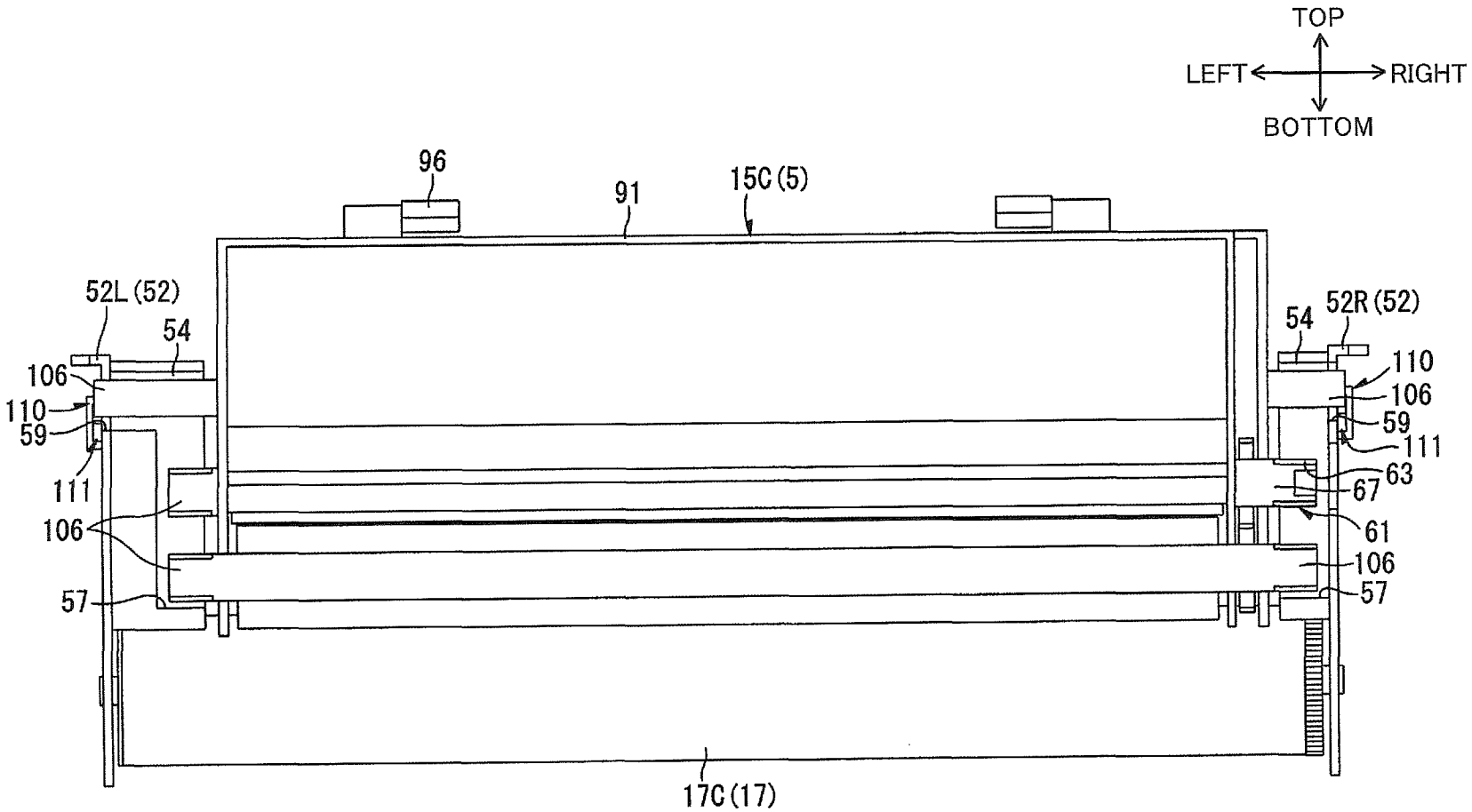
FIG. 11 is a cross-sectional view of the process unit taken along a line XI-XI in FIG. 2, as viewed from the front side.

Specifically, when the color developer cartridges 15 are mounted in the process frame 14 (shown in FIG. 11), the topmost cartridge guide ribs 106 of the color developer cartridges 15 are brought into engagement with the cartridge support grooves 59 of the process frame 14 from above. The topmost cartridge guide ribs 106 of the color developer cartridges 15 have lengths such that the cartridge guide ribs 106 protrude outward in the left-to-right direction from the left and right side plates 52 of the process frame 14 as shown in FIG. 11.

(5) Mounting Developer Cartridges in Process Frame

Prior to mounting the black developer cartridge 15K in the process frame 14, the stopcock 94 of the black developer cartridge 15K is in the vertical position as shown in FIG. 10A, and the shutter 102 of the lift 53 is in the closed position.

To mount the black developer cartridge 15K in the process frame 14, the user grips the cartridge handle 96 of the black developer cartridge 15K, positions the black developer cartridge 15K relative to the process frame 14, and inserts the black developer cartridge 15K down into the process frame 14 so that all cartridge guide ribs 106 are fitted into the cartridge guide grooves 57 and the shutter section 100 of the stopcock 94 is fitted into the lift-side relaying part 85.

When the developing roller 20 contacts the photosensitive drum 17, the black developer cartridge 15K is completely mounted in the process frame 14. As a result, the waste toner accommodating section 92 is disposed above the paper guide 41. In other words, the waste toner accommodating section 92 is provided in the process frame 14 and disposed in the opposite side of the belt cleaner 16 with respect to the paper guide 41.

At this time, as shown in FIG. 10A, the shutter section 100 of the stopcock 94 of the black developer cartridge 15K is fitted into the lift-side relaying part 85 and is interposed between the lift-side relaying part 85 and the accommodating-section-side relay part 93. Further, the fitting protrusion 107 of the stopcock 94 is fitted downward into the fitting through-hole 89 of the shutter 102. Through this engagement, the shutter 102 becomes movable together with the stopcock 94.

Figure 10B:
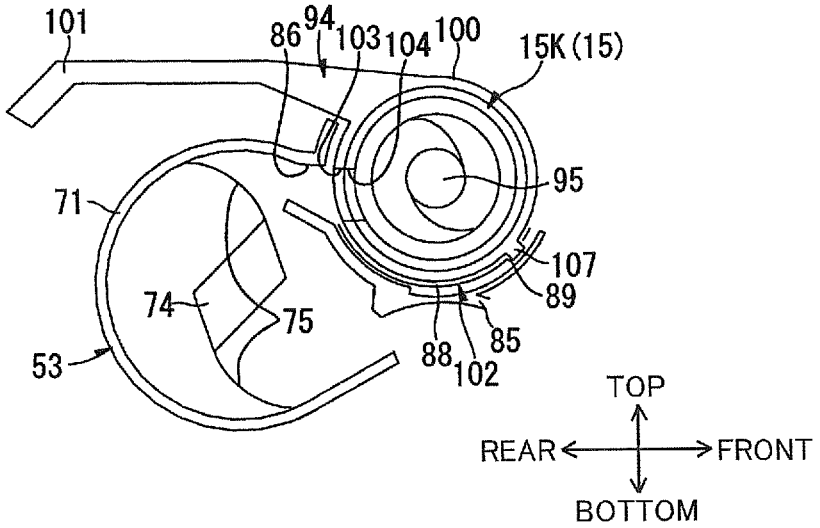

Then, the user moves the stopcock 94 from the vertical position to the horizontal position shown in FIG. 10B. As a result, the shutter section 100 of the stopcock 94 rotates counterclockwise in a left side view from the closed position to the open position. Accordingly, the operating-part-side communication port 103 is moved downward to allow fluid communication between the operating-part-side communication port 103 and the accommodating-section-side communication port 104 in the front-to-rear direction. At the same time, in association with movement of the stopcock 94, the shutter 102 rotates counterclockwise in a left side view from the closed position to the open position in which the shutter 102 is below the lift-side communication port 86.

At this time, the lift-side communication port 86, the operating-part-side communication port 103, and the accommodating-section-side communication port 104 overlap one another when projected in the front-to-rear direction. That is, the shutter 102 is in the open position that allows fluid communication between the accommodating-section-side relay part 93 and the lift-side relaying part 85 via the operating-part-side communication port 103.

In order to remove the black developer cartridge 15K from the process frame 14, the user lifts the grip part 101 upward so that the stopcock 94 is in the vertical position shown in FIG. 10A.

Through this operation, the shutter section 100 of the stopcock 94 is rotated from the open position clockwise in a left side view, slidingly moving the operating-part-side communication port 103 upward so that an inner surface of the shutter section 100 confronts the accommodating-section-side communication port 104 in the front-to-rear direction. At the same time, in association with movement of the stopcock 94, the shutter 102 rotates from the open position clockwise in a left side view so that the shutter 102 confronts the lift-side communication port 86 in the front-to-rear direction. At this time, the shutter 102 is in the closed position for prohibiting fluid communication between the accommodating-section-side relay part 93 and the lift-side relaying part 85.

Next, while the stopcock 94 is maintained in the vertical position, the user pulls the black developer cartridge 15K upward and removes the black developer cartridge 15K from the process frame 14. The fitting protrusion 107 of the stopcock 94 is disengaged from the fitting through-hole 89 of the shutter 102. While the shutter 102 remains in the closed position, the black developer cartridge 15K is completely removed from the process frame 14.

In order to mount each color developer cartridge 15 in the process frame 14, the user grips the cartridge handle 96 of the developer cartridge 15 and positions the color developer cartridge 15 so that the developing roller 20 is exposed on the rear side. The user then inserts the color developer cartridge 15 down into the process frame 14 so that all the cartridge guide ribs 106 are fitted into the corresponding cartridge guide grooves 57. As shown in FIG. 11, the color developer cartridge 15 is completely mounted in the process frame 14 when the developing roller 20 contacts the photosensitive drum 17.

To remove each of the color developer cartridges 15 from the process frame 14, the user simply pulls the color developer cartridge 15 upward.

3. Detailed Description of Main Casing (1) Structure of Main Casing

As shown in FIG. 12, the main casing 2 includes a pair of left and right projections 118 and a pair of left and right guide rails 119.

The projections 118 are disposed below the scanning unit 10, opposing each other at a distance in the left-to-right direction, and extend in the front-to-rear direction. The projections 118 are positioned so as to contact the top portions of the urging members 97 of the developer cartridges 15 from above when the process unit 11 is mounted in the main casing 2.

The guide rails 119 are disposed below the projections 118 and positioned at a substantially center section of the main casing 2 in the upper-to-lower direction. The guide rails 119 extends in the front-to-rear direction from a front section of the main casing 2 to a position above a rear end portion of the transfer unit 12. Each guide rail 119 has an upper surface that extends horizontally in the front-to-rear direction, and slopes downward to the rear at its rear terminal end 119A.

(2) Mounting Process Unit in Main Casing

Figure 13A:
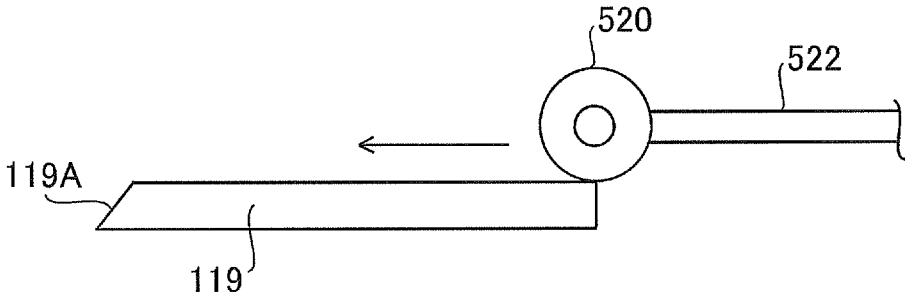

In order to mount the process unit 11 in the main casing 2, the user first opens the front cover 6 on the main casing 2, as shown in FIG. 12. Next, the user inserts a rear end of the process unit 11 into the main casing 2 so that the rollers 520 on the rear end of the process frame 14 are disposed on the upper surfaces of the guide rails 119 as shown in FIG. 13A.

Figure 13B:
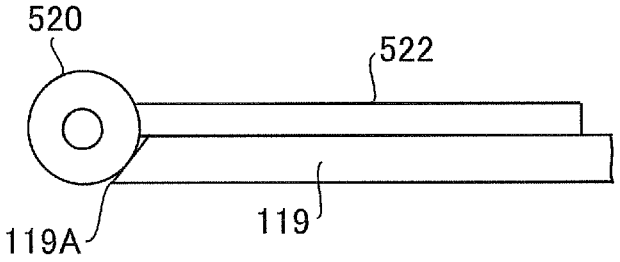

Subsequently, the user grips the frame handle 58 to push the process unit 11 rearward so that the rollers 520 on the process frame 14 rotatably move along the upper surfaces of the guide rails 119. As a result, the process unit 11 is slidingly moved rearward from the front along the guide rails 119. When the rollers 520 reach the rear terminal ends 119A of the guide rails 119, the rollers 520 move downward along the sloped surfaces at the rear terminal ends 119A, whereupon the ribs 522 of the process frame 14 are brought into abutment contact with the guide rails 119 as shown in FIG. 13B. As a result, the process unit 11 is completely mounted in the main casing 2 as shown in FIG. 1.

At this time, each of the photosensitive drums 17 contacts the top portion of the conveying belt 30 and confronts a respective transfer roller 31 through the conveying belt 30. In addition, the urging members 97 on each developer cartridge 15 contact lower surfaces of the projections 118 formed in the main casing 2. An urging force of the compression springs 99 urges the developer cartridges 15 toward the photosensitive drums 17. Hence, each of the developing rollers 20 resiliently contacts the corresponding photosensitive drum 17.

Further, the topmost cartridge guide ribs 106 on both sides of the color developer cartridges 15 are fitted into the depressions 113 of the translation cam mechanism 110 from above (shown in FIG. 6).

In addition, the belt cleaning roller 24 becomes disposed diagonally above and frontward of the driven roller 29 and contacts, at its lower rear edge, a part of the conveying belt 30 that is stretched around the driven roller 29. The rear end portion of the paper guide 41 becomes disposed in confrontation with the front top portion of the conveying belt 30 in the upper-to-lower direction.

In other words, the rollers 520 and the ribs 522 provided on the process frame 14 and the guide rails 119 and their rear terminal ends 119A provided in the main casing 2 serve as positioning members for positioning the photosensitive drums 17, the paper guide 41, and the belt cleaning roller 24 relative to the conveying belt 30 so that the photosensitive drums 17 are located on the upper side of the conveying belt 30, the paper guide 41 is located on the upper front side of the conveying belt 30, and the belt cleaner 16 is located on the upper front side of the conveying belt 30, to thereby ensure that the photosensitive drums 17 are located on the upper side of the conveying belt 30 similarly to the paper guide 41 that is located on the upper side of the belt cleaner 16.

(3) Drive Force Transmission to Belt Cleaner and Lift

A drive force is inputted from a drive source (not shown) provided in the main casing 2 into the first screw gear 66 for rotating the first screw gear 66 clockwise in a left side view (hereinafter referred to as "forward rotation"), as shown in FIG. 5.

The drive force inputted into the first screw gear 66 is transmitted to the second blade gear 76*b* to rotate the second blade gear 76*b* counterclockwise in a left side view (hereinafter referred to as "reverse rotation").

Next, the second blade gear 76*b* transmits the drive force to the first blade gear 76*a* and the third blade gear 76*c*, driving the first blade gear 76*a* and the third blade gear 76*c* in the forward rotation.

Further, the third blade gear 76*c* transmits the drive force via the fourth blade gear 76*d*, the fifth blade gear 76*e* and the sixth blade gear 76*f* to the seventh blade gear 76*g*, driving the fourth blade gear 76*d* and the sixth blade gear 76*f* in the reverse rotation and the fifth blade gear 76*e* and the seventh blade gear 76*g* in the forward rotation. Accordingly, the drive force is transmitted to each of the blade members 72 so as to drive four rearward blade members 72 in the frontward rotation and three frontward blade members 72 in the reverse rotation.

In addition, the drive force inputted into the first screw gear 66 is transmitted via the first screw 27 to the gear train 64 provided on the right end of the first screw 27. The gear train 64 then transmits the drive force to the relay roller gear 68 and the cleaning roller gear 69, thereby rotating the relay roller 25 and the belt cleaning roller 24.

4. Operation of Process Unit (1) Operation for Collecting Waste Toner

Prior to performing an image forming operation, the waste toner captured on the drum cleaning roller 19 is collected.

In order to collect the waste toner, initially, the color developer cartridges 15 are separated from the corresponding photosensitive drums 17.

In order to separate the color developer cartridges 15 from their respective photosensitive drums 17, the translation cam drive gears 112 are rotated clockwise in a left side view by the drive force from the drive source (not shown) in the main casing 2, moving the translation cams 111 frontward.

The topmost cartridge guide ribs 106 on the color developer cartridges 15 are pushed upward along the sloped rear edges of the depressions 113 of the translation cams 111. Consequently, the color developer cartridges 15 are lifted upward against the urging force of the urging members 97. When the color developer cartridges 15 are lifted upward, the developing rollers 20 in the color developer cartridges 15 separate from the corresponding photosensitive drums 17.

Next, a bias having opposite polarity to the cleaning bias is applied to the drum cleaning rollers 19. The bias causes the waste toner temporarily carried on the drum cleaning rollers 19 to be repelled back to the photosensitive drums 17 and discharged onto the conveying belt 30. As the conveying belt 30 circulates, the waste toner discharged on the top surface of the conveying belt 30 is circulated along the bottom of the transfer unit 12 and brought back to a position opposite the belt cleaning roller 24.

At this time, the waste toner discharged from the drum cleaning roller 19 onto the conveying belt 30 is captured on the belt cleaning roller 24 by the cleaning bias applied thereto. The waste toner is then transferred to the relay roller 25, is scraped off with the scraper 48, and is stored in the cleaner-side waste toner retaining section 26.

As shown in FIG. 9, the waste toner stored in the cleaner-side waste toner retaining section 26 is conveyed leftward by rotation of the first screw 27 (clockwise rotation in a left side view) and is supplied to the bottommost lift-side waste toner retaining part 71 in the lift 53.

The waste toner stored in the bottommost lift-side waste toner retaining part 71 is conveyed upward along a zigzag path by rotation of the blade members 72 disposed in the lift-side waste toner retaining parts 71. The blade member 72 in the topmost lift-side waste toner retaining part 71 supplies the waste toner to the accommodating-section-side relay part 93 of the waste toner accommodating section 92 through the lift-side communication port 86, the operating-part-side communication port 103 and the accommodating-section-side communication port 104.

The waste toner supplied to the accommodating-section-side relay part 93 is conveyed rightward by rotation of the second screw 95 (counterclockwise in a left side view), and is accumulated in the waste toner accommodating section 92. Collection of the waste toner is thus completed.

(2) Image Forming Operation

In order to form an image in black with the color laser printer 1, the color laser printer 1 is placed in a monochrome mode, wherein the black developer cartridge 15K is in contact with the black photosensitive drum 17K but the color developer cartridges 15 are separated from their respective photosensitive drums 17.

In order to form a color image, the color laser printer 1 is placed in a color mode, wherein the color developer cartridges 15, which have been separate from the photosensitive drums 17 during the monochromatic mode, are brought into contact with their respective photosensitive drums 17. In order to bring the color developer cartridges 15 into contact with the photosensitive drums 17, the translation cam drive gears 112 are rotated counterclockwise in a left side view, moving the translation cams 111 rearward.

The topmost cartridge guide ribs 106 of the color developer cartridges 15 slide down along the sloped rear edges of the depressions 113 formed in the translation cams 111 and become fitted in the corresponding depressions 113. Consequently, the color developer cartridges 15 are moved downward by the urging force of the urging members 97 so that the developing rollers 20 of the color developer cartridges 15 are brought into contact with their corresponding photosensitive drums 17.

Accordingly, in the color mode for forming a color image, all the developer cartridges 15K, 15Y, 15M, and 15C are in contact with all the photosensitive drums 17. Therefore, the color laser printer 1 can form a color image.

Both in the monochrome mode and the color mode, as described above, the topmost sheets P accommodated in the paper tray 7 are conveyed toward the position between the separating roller 42 and the separating pad 43 in association with rotation of the feeding roller 8. The sheets P are separated on a sheet-by-sheet basis by the separating roller 42 and the separating pad 43. Subsequently, while guided by the supplementary roller 44 and the feeding path 9, each sheet P is conveyed to the position where the registration rollers 45 are in confrontation with each other.

After passing between the registration rollers 45, the sheet P is conveyed by the rotation of the registration rollers 45 toward a position between the front end portion of the upper guide wall 46 and the front end portion of the lower guide wall 47. Then, the sheet P is conveyed through the paper guide 41 from its front end to its rear end along the curved shape of the upper guide wall 46 and the lower guide wall 47, while passing above the cleaner-side waste toner retaining section 26, the relay roller 25, and the belt cleaning roller 24.

The sheet P comes out of the paper guide 41 at a position between the rear end portion of the upper guide wall 46 and the rear end portion of the lower guide wall 47, and contacts the front top portion of the conveying belt 30 positioned frontward of the black photosensitive drum 17K.

As the conveying belt 30 circulates, the sheet P on the conveying belt 30 is conveyed rearward and passes between the black photosensitive drum 17K and the conveying belt 30. Then, as described above, an image is formed on the sheet P.

As described above, in the color laser printer 1 and the process unit 11 according to the embodiment, as shown in FIG. 1, the process frame 14, which retain the four photosensitive drums 17 such that the photosensitive drums 17 are disposed in confrontation with the conveying belt 30 in the upper-to-lower direction, is provided with the belt cleaner 16 for removing the residual toner on the conveying belt 30.

Hence, the belt cleaner 16 can easily be accessed for maintenance from a side the same as that of the photosensitive drums 17.

Further, the paper guide 41 is disposed above the belt cleaner 16 and is positioned to overlap the belt cleaner 16 when projected in the upper-to-lower direction. Hence, the paper guide 41 can guide the sheet P to the conveying belt 30 so that the sheet P is conveyed above the belt cleaner 16.

Accordingly, the paper guide 41 can guide the sheet P to the conveying belt 30, while conveying the sheet P above the belt cleaner 16, that is, not between the belt cleaner 16 and the conveying belt 30. The paper guide 41 can guide the sheet P to a position on the conveying belt 30, the position being downstream in the conveying direction from the cleaning position on the conveying belt 30, at which the belt cleaner 16 removes the residual toner from the conveying belt 30, and being upstream in the conveying direction from the confronting positions on the conveying belt 30, at which the photosensitive drums 17 confront the conveying belt 30. This configuration can prevent the sheet P from contacting the belt cleaner 16 and from being grimed by the belt cleaner 16.

In the color laser printer 1 and the process unit 11 according to the embodiment, the waste toner accommodating section 92 is disposed above the paper guide 41 and is retained in the process frame 14, as shown in FIG. 1. In other words, the waste toner accommodating section 92 is located on an opposite side of the belt cleaner 16 with respect to the paper guide 41.

Hence, the waste toner accommodating section 92 is provided by making use of the space above the paper guide 41.

Further, since the belt cleaner 16 and the waste toner accommodating section 92 are separately provided, the belt cleaner 16 can be formed smaller in size, compared to a case that the belt cleaner 16 and the waste toner accommodating section 92 are integrally provided.

Accordingly, the paper guide 41 can be easily provided by making use of the space between the belt cleaner 16 and the waste toner accommodating section 92.

In the color laser printer 1 and the process unit 11 according to the embodiment, the black developer cartridge 15K is integrally provided with the waste toner accommodating section 92.

Hence, concurrently with exchanging the black developer cartridge 15K, the waste toner accommodating section 92 can be exchanged. Accordingly, the belt cleaner 16 can easily be accessed for maintenance.

In the color laser printer 1 and the process unit 11 according to the embodiment, the waste toner collected by the belt cleaner 16 can be conveyed leftward by the first screw 27 and the waste toner conveyed by the first screw 27 can be conveyed to the waste toner accommodating section 92 by the lift 53.

Hence, the waste toner is once conveyed leftward so as to bypass the paper guide 41, and then, is conveyed to the waste toner accommodating section 92.

In the color laser printer 1 and the process unit 11 according to the embodiment, as shown in FIG. 9, the process frame 14 includes a pair of side plates 52 that support the longitudinal ends of the photosensitive drums 17 so that the photosensitive drums 17 are rotatable relative to the side plates 52, and the lift 53 is provided on the left side plate 52L and disposed between both of the side plates 52.

That is, the lift 53 is disposed at an inner side of the side plates 52 in the left-to-right direction. Hence, when mounting the process frame 14 in or removing the process frame 14 from the main casing 2 of the color laser printer 1, this configuration can prevent the lift 53 from interfering with other components in the color laser printer 1. As a result, the process frame 14 can be easily mounted in the main casing 2 or removed from the main casing 2.

In the color laser printer 1 and the process frame 14 according to the embodiment, as shown in FIG. 9, the blade gears 76 for transmitting the drive force to the lift 53 is disposed between the left side plate 52L and the lift 53.

Hence, the blade gears 76 can reliably transmit the drive force to the lift 53 even though the lift 53 is disposed at the inner side of the side plates 52 in the left-to-right direction.

Further, when mounting the developer cartridges 15 in or removing the developer cartridges 15 from the process frame 14, this configuration can prevent the developer cartridges 15 from interfering with the blade gears 76. Accordingly, the blade gears 76 can be protected from being damaged by interference with the developer cartridges 15.

Further, when mounting the developer cartridges 15 in or removing the developer cartridges 15 from the process frame 14, this configuration can prevent toner of the developer cartridges 15 from being deposited on the blade gears 76. Accordingly, malfunction of the lift 53 can be prevented.

In the color laser printer 1 and the process unit 11 according to the embodiment, as shown in FIG. 9, the second screw 95 is provided for conveying the toner conveyed to the waste toner accommodating section 92 rightward.

Hence, the conveyed toner can be stored in the waste toner accommodating section 92 with uniform thickness along the left-to-right direction.

While the invention has been described in detail with reference to the embodiment thereof, it would be apparent to those skilled in the art that various changes and modifications may be made therein without departing from the spirit of the invention.

For example, in the above-described embodiment, the black developer cartridge 15K is provided with the waste toner accommodating section 92, while the color developer cartridges 15 are not provided with the waste toner accommodating section 92. However, the waste toner accommodating section 92 may be integrally provided in any of the developer cartridges 15K, 15Y, 15M, and 15C. Two or more waste toner accommodating sections may be provided in two or more of the developer cartridges 15K, 15Y, 15M, and 15C.

In the above-described embodiment, the photosensitive drums 17 and the conveying belt 30 are arranged in the vertical direction so that the photosensitive drums 17 are located on the upper side of the conveying belt 30. The paper guide 41 and the belt cleaner 16 are arranged in the vertical direction so that the paper guide 41 is on the upper side of the belt cleaner 16. That is, the relative position between the paper guide 41 and the belt cleaner 16 is such that the paper guide 41 is on the photosensitive drum side and the belt cleaner 16 is on the conveying belt side with respect to the vertical direction. Part of the paper guide 41 is overlapped with part of the belt cleaner 16 when projected in the vertical direction.

However, a direction, in which the photosensitive drums 17 and the conveying belt 30 are arranged, may be other than the vertical direction. That is, the photosensitive drums 17 may be located on one side of the conveying belt 30 with respect to any direction (which will be referred to as "reference direction" hereinafter). Still in this case, it is preferable that the paper guide 41 and the belt cleaner 16 are arranged in the reference direction such that the paper guide 41 is on the photosensitive drum side and the belt cleaner 16 is on the conveying belt side with respect to the reference direction, and that at least part of the paper guide 41 is overlapped with at least part of the belt cleaner 16 when projected in the reference direction.

In the above-described embodiment, the developer case 91 is integrally formed with the waste toner accommodating section 92 such that the waste toner accommodating section 92 is in the form of a chamber formed in the developer case 91. However, the waste toner accommodating section 92 may be provided separately from the developer case 91. Still in this case, it is preferable that the waste toner accommodating section 92 is provided at a position opposite to the belt cleaner 16 with respect to the paper guide 41.

In the above description, the belt cleaner 16 is positioned relative to the conveying belt 30 so that the belt cleaning roller 24 is disposed diagonally above and frontward of the conveying belt 30. However, the belt cleaning roller 24 may not be disposed diagonally above and frontward of the conveying belt 30. If the paper guide 41 can be disposed above the belt cleaner 16 with at least partly being overlapped with the belt cleaner 16 in the vertical direction, the belt cleaning roller 24 may be disposed above the conveying belt 30, may be disposed in front of the conveying belt 30, or may be disposed diagonally below and frontward of the conveying belt 30.

In the above description, the rollers 520 and the ribs 522 provided on the process frame 14 and the guide rails 119 and their rear terminal ends 119A provided in the main casing 2 serve as the positioning members for positioning the photosensitive drums 17, the paper guide 41, and the belt cleaning roller 24 relative to the conveying belt 30. However, the positioning members may be provided in other various forms.

In the above-described embodiment, the photosensitive drums 17 are retained by the process frame 14. However, the photosensitive drums 17 may not be retained by the process frame 14, but may be mounted directly in the main casing 2.

In the above-described embodiment, the process frame 14 is integrally provided with the paper guide 41 and the belt cleaner 16. However, the process frame 14 may not be integrally provided with the paper guide 41 and the belt cleaner 16. The paper guide 41 and the belt cleaner 16 may be mounted directly in the main casing 2.

The invention claimed is:

1. A combination of a first developing agent container and a second developing agent container, each being configured to be mountable in a casing of an image forming device, the image forming device including a first image bearing member, a second image bearing member, and an endless belt configured to receive developing agent from the first image bearing member and the second image bearing member, the first developing agent container comprising:

a first supply chamber therein, the first supply chamber being configured to contain a first developing agent of a first color, the first developing agent being supplied to the first image bearing member, and the second developing agent container comprising:

a second supply chamber configured to contain a second developing agent of a second color different from the first color, the second developing agent being supplied to the second image bearing member;

a port;

a waste chamber configured to contain residual first developing agent and residual second developing agent received by the port, the port in fluid communication with the waste chamber and configured to receive the residual first developing agent and the residual second developing agent collected and transferred from the endless belt; and a wall defining a side of the second supply chamber and a side of the waste chamber such that the second supply chamber and the waste chamber are arranged in juxtaposition with each other in an orthogonal direction orthogonal to an axial direction of a developing roller, wherein the first developing agent container is not provided with a waste chamber configured to contain the residual first developing agent and the residual second developing agent collected and transferred from the endless belt, wherein the first developing agent of the first color is one of a yellow-color developing agent, a magenta-color developing agent, and a cyan-color developing agent, and the second developing agent of the second color is a black-color developing agent, and wherein the waste chamber and the first supply chamber are disposed on opposite sides of the second supply chamber in the orthogonal direction.

2. The combination as claimed in claim 1, further comprising the developing roller, the developing roller being configured to supply the second image bearing member with the second developing agent in the second supply chamber.

3. The combination as claimed in claim 1, wherein the first developing agent container further comprises a first agitator provided in the first supply chamber and configured to agitate the first developing agent contained in the first supply chamber; and wherein the second developing agent container further comprises a second agitator provided in the second supply chamber and configured to agitate the second developing agent contained in the second supply chamber.

4. The combination as claimed in claim 1, wherein the port is disposed at an upper portion of the waste chamber.

* * * * *